US007401367B2

(12) United States Patent
Gehr et al.

(10) Patent No.: US 7,401,367 B2
(45) **Date of Patent: *Jul. 22, 2008**

(54) PLAYARD

(75) Inventors: Arthur L. Gehr, East Earl, PA (US); Michael L. Longenecker, Ephrata, PA (US); Robert T. Pike, Reading, PA (US); Gregory S. Sellers, Christiana, PA (US); Joshua E. Clapper, King of Prussia, PA (US)

(73) Assignee: Graco Children's Products Inc., Exton, PA (US)

( * ) Notice: Subject to any disclaimer, the term of this patent is extended or adjusted under 35 U.S.C. 154(b) by 153 days.

This patent is subject to a terminal disclaimer.

(21) Appl. No.: 10/995,521

(22) Filed: Nov. 24, 2004

(65) Prior Publication Data

US 2005/0150046 A1 Jul. 14, 2005

Related U.S. Application Data

(63) Continuation-in-part of application No. 10/446,132, filed on May 28, 2003, now Pat. No. 6,865,756.

(51) Int. Cl.
*A47D 7/00* (2006.01)

(52) U.S. Cl. ..... 5/99.1; 5/98.1

(58) Field of Classification Search ..... 5/99.1, 5/98.1, 98.2, 93.1, 182; 256/25; 135/145, 135/96

See application file for complete search history.

(56) References Cited

U.S. PATENT DOCUMENTS 927,738 A * 7/1909 Malaby ..... 135/145

(Continued)

FOREIGN PATENT DOCUMENTS

EP 1 481 617 A1 12/2004

(Continued)

OTHER PUBLICATIONS

Graco Children's Products Inc.: "Instruction Manual: Pack 'n Play Sport Playard 9920—Graco ISPP034AC 05/04" Internet Instruction Manual, [Online] Oct. 25, 2004, Retrieved from the Internet: URL:http://web.archive.org/web/20041025002518/http://www.gracobaby.com/assets/pdfs/instructions/ISPP034AC.pdf>.

(Continued)

*Primary Examiner*—Alexander Grosz
(74) *Attorney, Agent, or Firm*—Lempia Braidwood LLC

(57) ABSTRACT

A collapsible frame structure, movable between an open arrangement and a folded arrangement, includes a plurality of legs, a plurality of cross members arranged in pairs, a plurality of slider joints and pivot joints, and at least one latch mechanism. Each pair of cross members is located between respective adjacent legs to form sides of the collapsible frame structure that define an interior of the collapsible frame structure. Each slider joint slidingly engages a respective one of the legs and pivotably attaches to two adjacent cross members. Each pivot joint is at a respective one of the legs to pivotably attach two adjacent cross members. The latch mechanism, which is mounted to another frame component of the collapsible frame structure, remains so mounted in both the open arrangement and the folded arrangement. Nonadjacent legs and nonadjacent sides of the collapsible frame structure remain unconnected across an interior of the collapsible frame structure.

15 Claims, 27 Drawing Sheets

U.S. PATENT DOCUMENTS

| | | | | |
|---|---|---|---|---|
| 1,950,603 | A * | 3/1934 | Fischer | 5/98.3 |
| 2,698,443 | A | 1/1955 | Ralick | |
| 2,974,325 | A | 3/1961 | Mango | |
| 3,789,439 | A | 2/1974 | Berg et al. | |
| 4,186,454 | A | 2/1980 | Cone | |
| 4,483,026 | A | 11/1984 | Kassai | |
| 4,683,600 | A | 8/1987 | Beger | |
| 4,967,432 | A | 11/1990 | Kujawski et al. | |
| 5,241,716 | A | 9/1993 | Kohus | |
| 5,384,925 | A | 1/1995 | Vail | |
| 5,697,111 | A | 12/1997 | Dillner et al. | |
| 5,711,040 | A | 1/1998 | Huang | |
| 5,961,180 | A | 10/1999 | Greger et al. | |
| 6,035,877 | A | 3/2000 | Losi et al. | |
| 6,067,676 | A | 5/2000 | Carnahan et al. | |
| 6,421,850 | B1 | 7/2002 | Welsh | |
| 6,550,801 | B1 | 4/2003 | Newhard | |
| 2002/0016991 | A1 | 2/2002 | Brown et al. | |
| 2003/0061658 | A1 | 4/2003 | Longenecker | |
| 2005/0166316 | A1 | 8/2005 | Gehr et al. | |

FOREIGN PATENT DOCUMENTS

| | | |
|---|---|---|
| FR | 1 053 010 | 1/1954 |
| FR | 2 361 846 | 3/1978 |
| FR | 2 769 815 | 4/1999 |

OTHER PUBLICATIONS

International Search Report of PCT/US2004/039612 dated Aug. 26, 2005.
Translation of FR 2 769 815 (14 pages).
Photographs of DeWalt Saw Horse for DeWalt Compound Miter Saw (2 pages).

* cited by examiner

PLAYARD

CROSS-REFERENCE TO RELATED APPLICATIONS

This application is a continuation-in-part of U.S. application Ser. No. 10/446,132, filed May 28, 2003, issued as U.S. Pat. No. 6,865,756, which is incorporated by reference in its entirety.

FIELD OF THE INVENTION

This invention relates to a playard. More specifically, this invention relates to a collapsible playard and a collapsible frame structure and latch assembly for the playard.

BACKGROUND OF THE INVENTION

Various types of collapsible frame structures for a juvenile product, such as a playpen, cot or bed, are known.

One known frame structure, for example, is for a portable playpen. The frame structure includes top rails, a plurality of rods arranged in X-shaped pairs equal in number to the sides of the playard, and a locking hinge arranged between each respective top rail of the playpen and a pivot point of the respective rod pairs.

Another known frame structure, suitable for a playpen or cot, includes four upper frame joints and four lower frame joints pivotably connected to frame legs, where the upper frame joints and lower frame joints are respectively located in the upper and lower corners to form a box structure. The box structure also includes a bottom base frame with four legs radially extending from a central coupling joint that allows the four legs to fold relative to the central joint and that facilitates the collapse of the entire structure.

There is a need in the art for a frame structure that may be unfolded to encompass a relatively large area, yet also provides sufficient protection and containment for a child inside the playard and remains light weight for good portability.

SUMMARY OF THE INVENTION

An aspect of the present invention relates to a collapsible frame structure. The collapsible frame structure is movable between an open arrangement and a folded arrangement. The collapsible frame structure includes a plurality of legs; a plurality of cross members arranged in pairs, each pair of cross members located between respective adjacent legs; a plurality of slider joints, each slider joint slidingly engaging a respective one of the legs and pivotably attached to two adjacent cross members; a plurality of pivot joints, each pivot joint at a respective one of the legs to pivotably attach two adjacent cross members; and at least one latch mechanism associated with one of the slider joints. The latch mechanism, when latched, prevents movement of the collapsible frame structure from the open arrangement to the folded arrangement.

Another aspect of the present invention relates to a collapsible frame structure movable between an open arrangement and a folded arrangement. The collapsible frame structure includes a plurality of legs; a plurality of cross members arranged in pairs, each pair of cross members located between respective adjacent legs; a plurality of slider joints, each slider joint slidingly engaging a respective one of the legs and pivotably attached to two adjacent cross members; a plurality of pivot joints, each pivot joint at a respective one of the legs to pivotably attach two adjacent cross members; and at least one latch mechanism associated with one of the pivot joints.

The latch mechanism, when latched, prevents movement of the collapsible frame structure from the open arrangement to the folded arrangement.

Another aspect of the present invention relates to a collapsible frame structure movable between an open arrangement and a folded arrangement. The collapsible frame structure includes a plurality of legs; a plurality of cross members arranged in pairs, each pair of cross members adjoining at a pivot and located between respective adjacent legs; a plurality of slider joints, each slider joint slidingly engaging a respective one of the legs and pivotably attached to two adjacent cross members; a plurality of pivot joints, each pivot joint at a respective one of the legs to pivotably attach two adjacent cross members; and at least one latch mechanism associated with one of the pivots. The latch mechanism, when latched, prevents movement of the collapsible frame structure from the open arrangement to the folded arrangement.

Another aspect of the present invention relates to a collapsible frame structure movable between an open arrangement and a folded arrangement. The collapsible frame structure includes a plurality of legs; a plurality of cross members arranged in pairs, each pair of cross members located between respective adjacent legs to form sides of the collapsible frame structure that define an interior of the collapsible frame structure; a plurality of slider joints, each slider joint slidingly engaging a respective one of the legs and pivotably attached to two adjacent cross members; a plurality of pivot joints, each pivot joint at a respective one of the legs to pivotably attach two adjacent cross members; and at least one latch mechanism at least one latch mechanism, mounted to another frame component of the collapsible frame structure, that remains so mounted in both the open arrangement and the folded arrangement. The interior of the collapsible frame structure is free of frame joints.

Another aspect of the invention relates to a collapsible frame structure movable between an open arrangement and a folded arrangement. The collapsible frame structure includes a plurality of legs; a plurality of cross members arranged in pairs, each pair of cross members located between respective adjacent legs to form sides of the collapsible frame structure that define an interior of the collapsible frame structure; a plurality of slider joints, each slider joint slidingly engaging a respective one of the legs and pivotably attached to two adjacent cross members; a plurality of pivot joints, each pivot joint at a respective one of the legs to pivotably attach two adjacent cross members; and at least one latch mechanism, mounted to another frame component of the collapsible frame structure, that remains so mounted in both the open arrangement and the folded arrangement. Nonadjacent legs and nonadjacent sides of the collapsible frame structure remain unconnected across an interior of the collapsible frame structure.

Another aspect of the invention relates to a collapsible frame structure movable between an open arrangement and a folded arrangement. The collapsible frame structure includes a plurality of legs; a plurality of cross members arranged in pairs, each pair of cross members adjoining at a pivot and located between respective adjacent legs; a plurality of slider joints, each slider joint slidingly engaging a respective one of the legs and pivotably attached to two adjacent cross members; a plurality of pivot joints, each pivot joint at a respective one of the legs to pivotably attach two adjacent cross members; and at least one latch mechanism mounted to one of the pivots, that remains so mounted in both the open arrangement and the closed arrangement.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

FIGS. 28A-28C are detail perspective views of the components of the latch assembly of FIG. 28, in which FIG. 28A is an assembled view and FIGS. 28B and 28C are partially exploded views.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
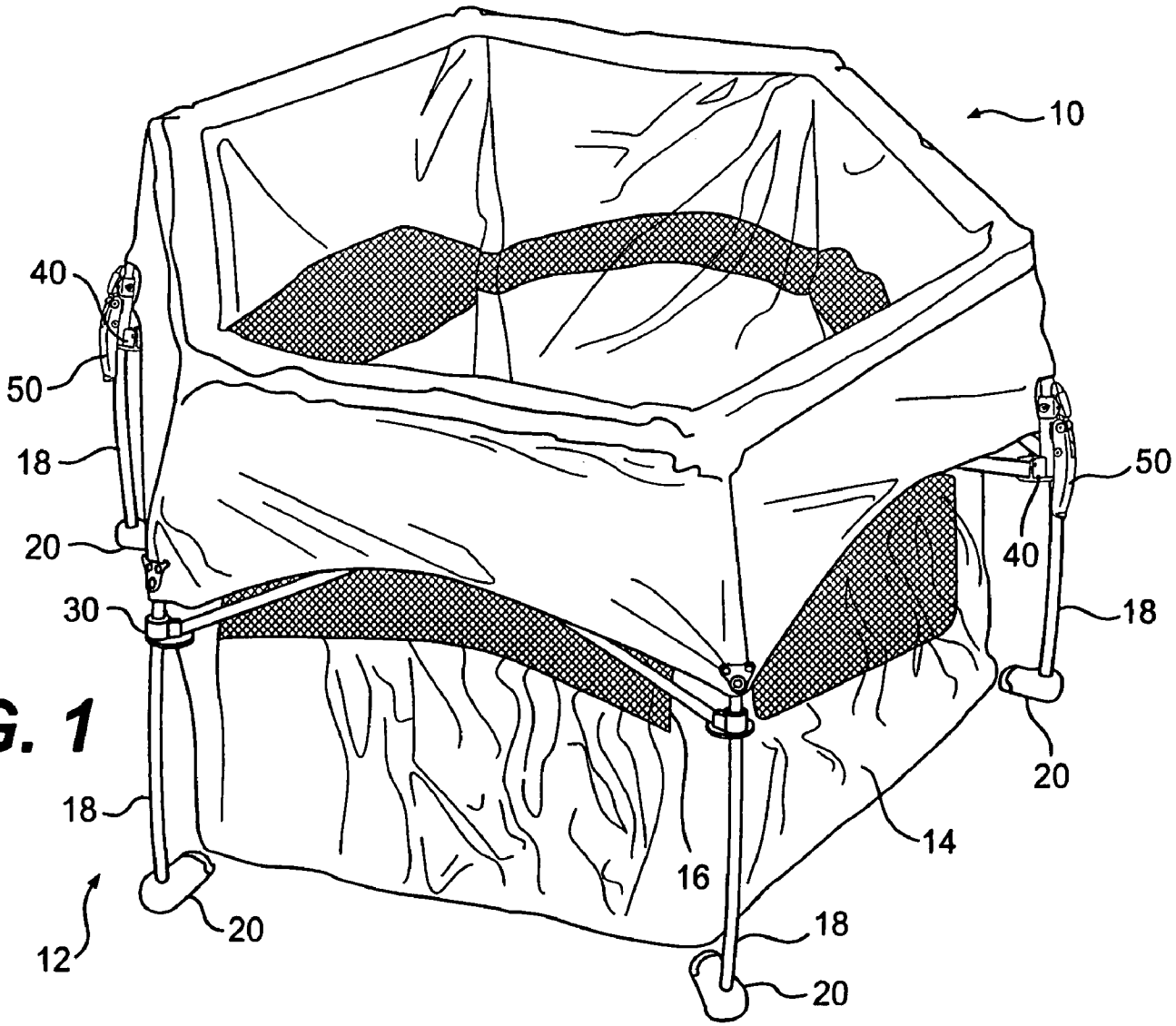
FIG. 1 is a perspective view that illustrates a playard according to an exemplary embodiment of the present invention.

FIG. 1 illustrates a playard 10 including a collapsible frame structure 12 according to an exemplary embodiment of the invention. The playard 10 also a soft goods or fabric enclosure 14 mounted to and supported by the collapsible frame structure 12. The present playard may be unfolded to encompass a relatively large area, yet still provides sufficient protection and containment for a child within the playard, as well as being relatively light weight and collapsible for storage. Thus, the playard provides a large play space while having a very compact fold. Also, the present playard is simple in construction and has fewer parts that require manual locking/unlocking than many conventional playards. The presently described playard has been designed with these considerations in mind.

The playard 10 is illustrated in FIG. 1 in a fully open arrangement. As can be seen, the playard 10 provides a secure, contained environment in which a child can play, and the playard is configured to be collapsed into a folded arrangement for travel or storage.

The enclosure 14 may be removed from the collapsible frame structure 12 and washed and cleaned. The enclosure 14 may contain a door or opening (not shown) to allow a child ingress into and egress out of the playard 10. The enclosure 14 may also include a number of windows 16, which are transparent or semitransparent, so that a child can see outside of the enclosure 14 through the windows 16. The windows 16 may comprise, for example, cloth that is thin and porous enough to be transparent or semitransparent, plastic, webbing, or mesh.

The collapsible frame structure 12 may be collapsed with or without the enclosure 14 attached. Thus, the collapsible frame structure 12 provides flexibility in not necessarily requiring that the enclosure 14 be detached prior to collapsing the collapsible frame structure 12.

Moreover, the collapsible frame structure 12 may be embodied in any size as desired. Thus, a large playard may be employed for outdoor use, while a smaller playard may be appropriate for indoor use. The collapsible nature of the frame structure 12 allows for ready transport of a playard of any size, even a larger playard.

Figure 2:
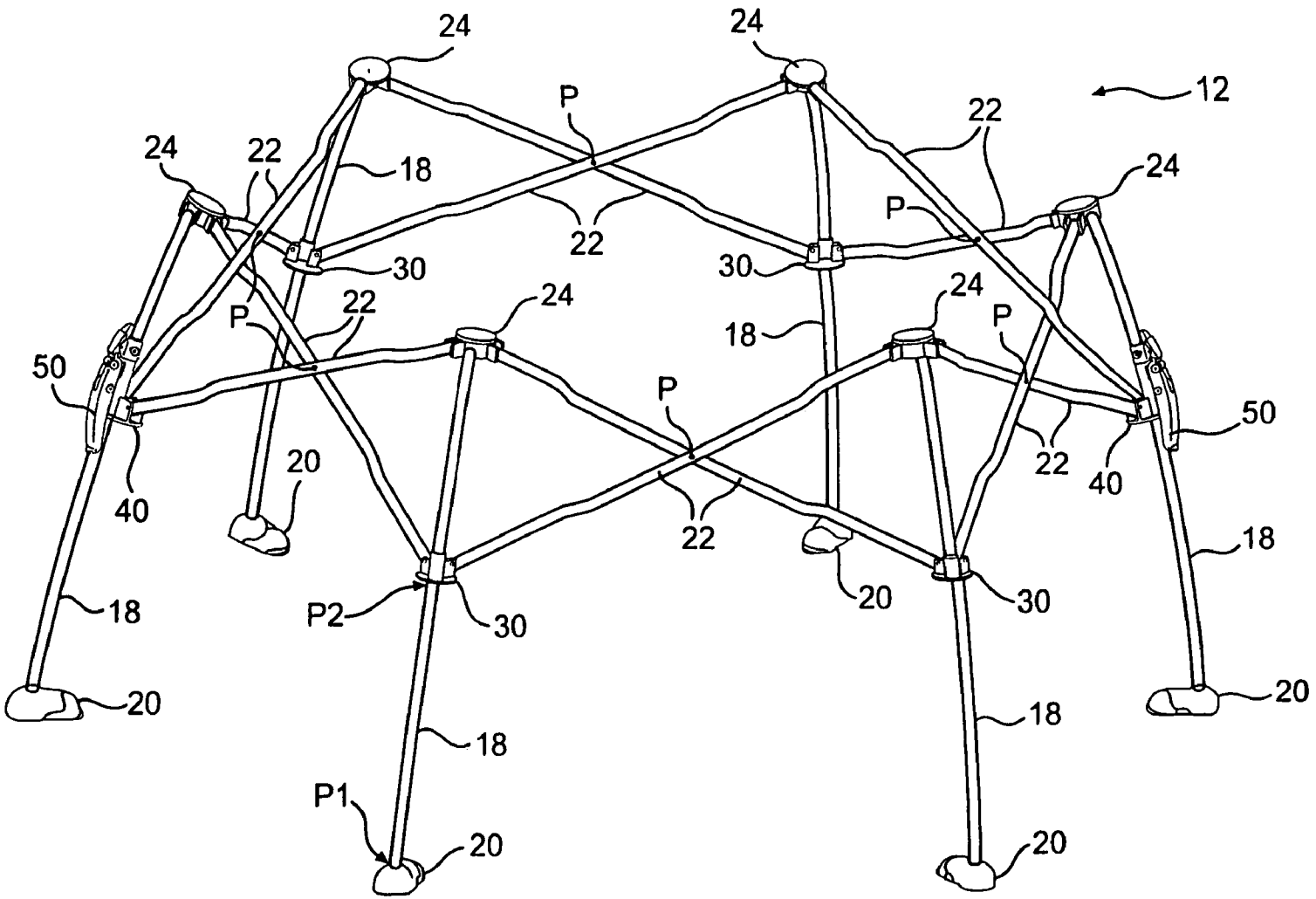
FIG. 2 is a perspective view illustrating a collapsible frame structure according to an exemplary embodiment of the present invention.

The collapsible frame structure 12 will now be described with respect to FIGS. 1 and 2. As can be seen in FIG. 2, the collapsible frame structure 12 includes a plurality of legs 18. The collapsible frame structure 12 as seen in FIG. 2 is arranged in a fully open arrangement, where the legs 18 are spaced at a distance from each other. As described below in connection with FIG. 8, the collapsible frame structure 12 may also be arranged in a folded arrangement.

Each of the legs 18 may comprise a hollow tube and may be made of plastic, metal, such as steel or aluminum, or any other suitable material. Hollow legs 18 are preferred because of their lightweight nature. This provides an advantage when the collapsible frame structure 12 is arranged in the folded arrangement and is carried, thus making the collapsible frame 12, and the playard 10, readily portable. The playard 10 has at least three legs 18, but it can have more, for example six, as shown in FIG. 2. The number of sides of the structure 12 generally is the same as the number of legs. The structure 12 may also be prismatic in shape.

The collapsible frame structure 12 may also include a plurality of feet 20, where each foot 20 is attached to and supports a respective one of the legs 18. The feet 20 may comprise metal, such as steel or aluminum, or plastic.

The collapsible frame structure 12 includes a plurality of cross members 22 arranged and extending, respectively, between adjacent legs 18. Like the legs 18, the cross members 22 may comprise hollow tubes and may be made of plastic or metal, such as steel or aluminum, or any other suitable material. Cross members 22 comprising hollow tubes are preferred because of their lightweight nature.

The plurality of cross members 22 may be arranged in pairs, where each pair of cross members 22 extends between respective adjacent legs 18. Each pair of cross members 22 may be arranged in an X-shape. In addition, each pair of cross members may be pivotally connected at pivots P so that, when the frame structure 12 is collapsed to the folded arrangement, the cross members 22 can pivot relative to each other.

Figure 4:
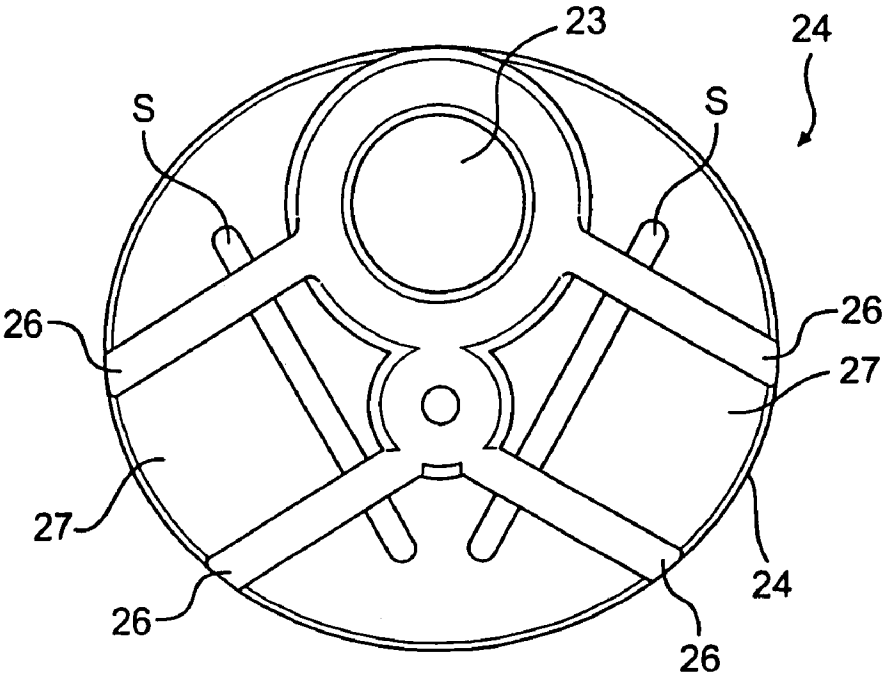
FIG. 4 is a bottom plan view of the pivot joint of FIG. 3.
Figure 17:
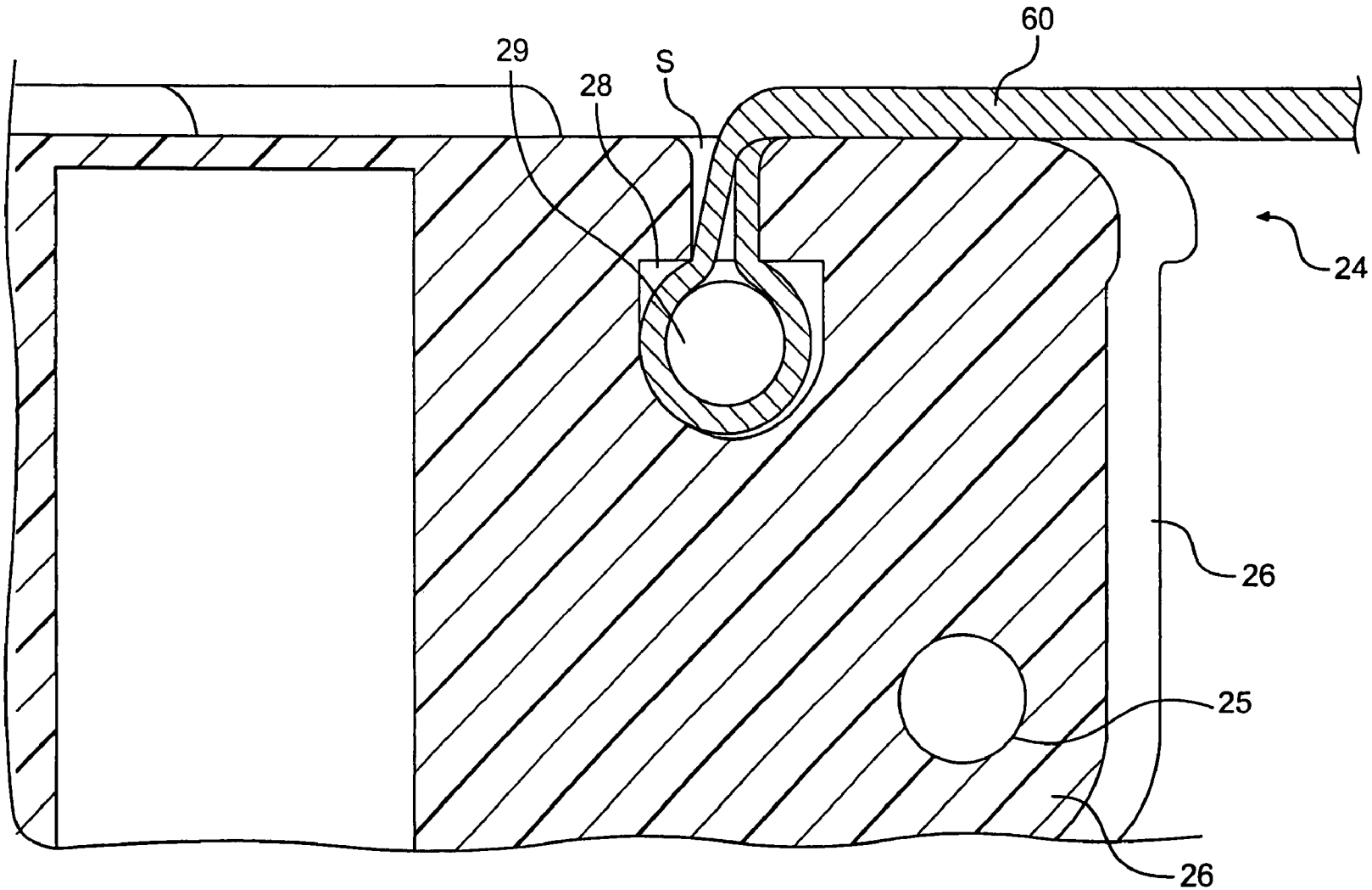
FIG. 17 is a cross-section of the pivot joint of FIG. 3 illustrating connection of a top rail to the pivot joint.
Figure 24:
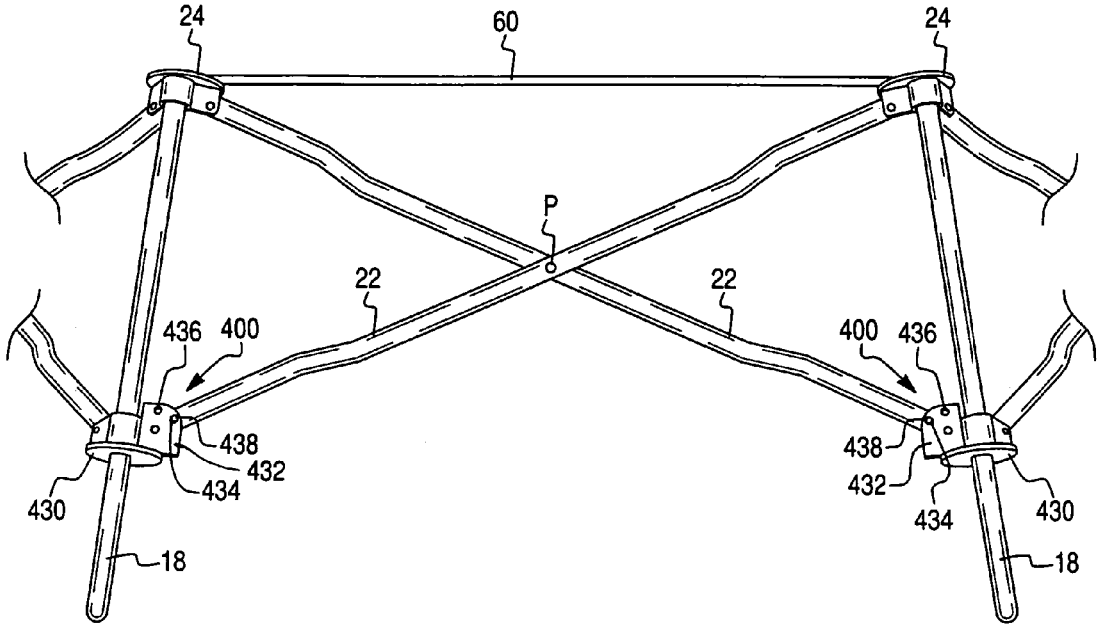
FIG. 24 is a side view illustrating a section of a collapsible frame structure having another exemplary latch assembly in accordance with the present invention.

The collapsible frame structure 12 includes a plurality of pivot joints. The pivot joints function to allow the cross members 22 to pivot relative to the legs 18. In this regard, the pivot joints may simply comprise pins to attach the cross members 22 to the legs 18. Another exemplary pivot joint 24 is illustrated in FIGS. 24 and 17. FIG. 4 is a bottom plan view of the pivot joint of FIG. 3. The pivot joints 24 are arranged on each leg 18, such as on an upper end of the leg 18. In this regard, leg 18 fits into recess 23 of the pivot joint 24. Each of the pivot joints 24 is pivotably attached to at least one adjacent cross member 22. That is, an end of a cross member 22 can be positioned within a recess 27 defined by adjacent walls 26. The end of the cross member can be pivotally secured in the respective recess 27 by a pin (not shown) that passes through holes 25 in walls 26 and through the end of the cross member 22.

Figure 5:
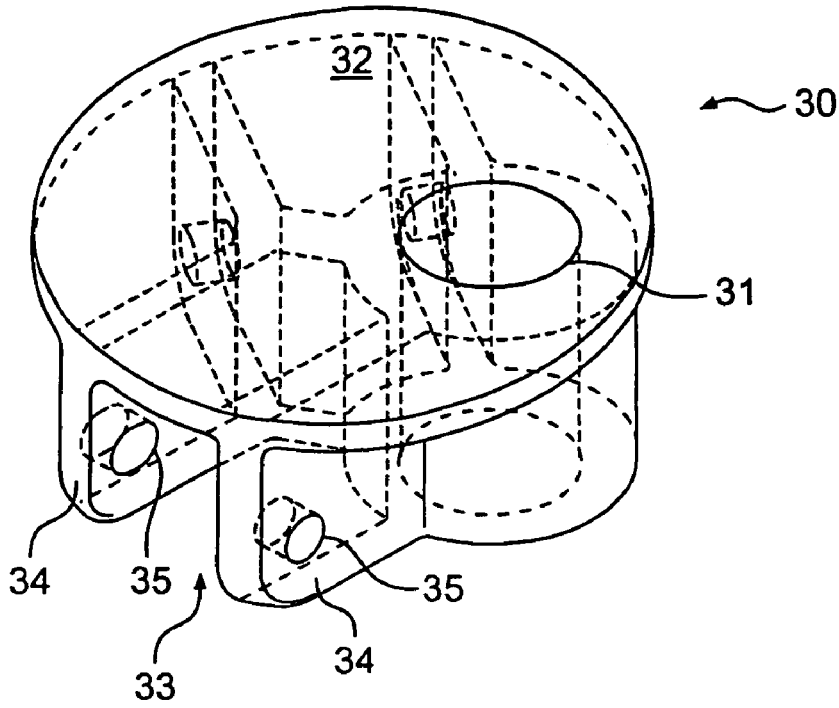
FIG. 5 is a perspective view illustrating a slider joint of the collapsible frame structure of FIG. 2.
Figure 6:
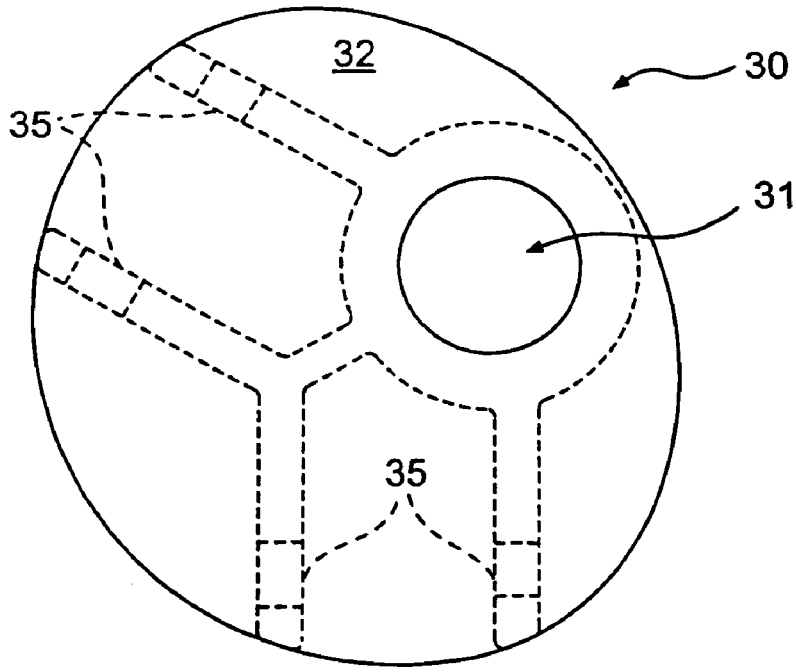
FIG. 6 is a bottom plan view of the slider joint of FIG. 5.
Figure 7:
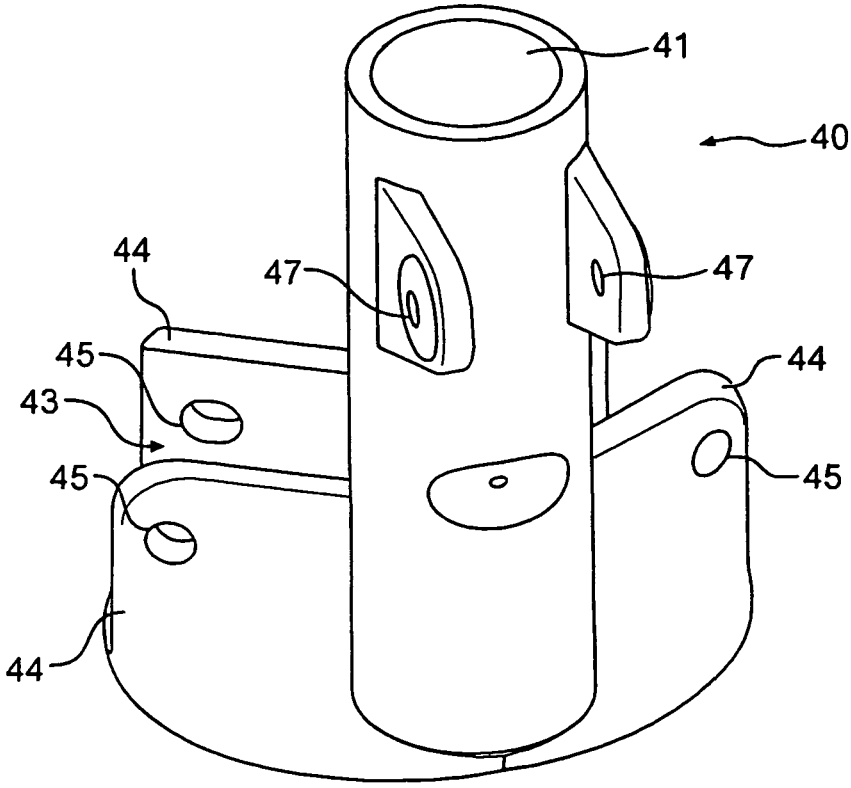
FIG. 7 is a perspective view illustrating another slider joint of the collapsible frame structure of FIG. 2.

The collapsible frame structure 12 also includes a plurality of slider joints. The slider joints function to allow an end of a respective cross member to slide up or down a respective leg to allow the frame to be opened or collapsed. Exemplary slider joints include, for example, slider joints 30, 40 as illustrated in FIGS. 1, 2, 5, 6, and 7. FIGS. 5 and 6 illustrate a slider joint 30 for those joints not attached to a latch mechanism 32 (described below). FIGS. 5 and 6 illustrate the slider joint 30 with the bottom of the joint 30 facing upward. That is, when the slider joint 30 is mounted to a leg 18, surface 32 of the joint 30 faces the foot 20 mounted to the leg 18, as shown in FIG. 2. FIG. 7 illustrates a slider joint 40 for use in conjunction with a latch mechanism 32 (described below). Each cross member 22 may be mounted to respective adjacent legs by a slider joint 30 or 40 on a first of the respective adjacent legs 18 and by the pivot joint 24 on a second of the respective adjacent legs 18. In configurations where the cross members 22 are arranged in pairs, each of the pivot joints 24 may be pivotably attached to two adjacent cross members 22, such as shown in FIG. 2.

Each of the slider joints 30, 40 slidingly engages a respective one of the legs 18. For example, the leg 18 passes through hole 31, 41 in slider joints 30, 40, respectively. The slider joints 30, 40 also are pivotably attached to at least one adjacent cross member 22. In configurations where the cross members 22 are arranged in pairs, each of the slider joints 30, 40 may be pivotably attached to two adjacent cross members 22, such as shown in FIG. 2. That is, the end of the cross member can be pivotally secured in recesses 33, 43 of an appropriate slider joint 30, 40 by a pin (not shown) that passes through holes 35, 45 in respective walls 34, 44 and through the end of the cross member 22.

As explained above, the slider joints 30, 40 may slide along respective legs 18 so as to move the cross members 22, and hence the collapsible frame structure 12, between the folded arrangement and the fully open arrangement. In this respect, referring to FIG. 2, each slider joint 30, 40 may be configured to slide between a first position P1 on its respective leg 18 corresponding to a folded arrangement of the collapsible frame structure 12, and a second position P2 on its respective leg corresponding to a fully open arrangement of the collapsible frame structure 12. As the slider joints 30, 40 slide along respective legs 18 toward the first and second positions P1, P2, respectively, they cause the cross members 22 to scissor close and open. As the cross members 22 scissor open, they expand the collapsible frame structure 12 substantially. When the slider joints 30 are in at second Position P2, each slider joint 30 is vertically separated from the corresponding pivot joint 24 on its respective legs 18 by a gap that is greater than the height of the slider joint 30.

The legs 18 may have a curved shape, at least between the first and second positions P1, P2 so as to facilitate collapsing the collapsible frame structure 12 into its folded arrangement. The first position P1 and the second position P2 generally correspond to the folded arrangement and the open arrangement, respectively. Alternatively, the legs 18 may be completely straight or have some other shape.

The collapsible frame structure 12 also includes at least one latch mechanism 50. Each latch mechanism 50 is configured to selectively engage at least one of the slider joints 40 with a respective leg 18. FIG. 2 illustrates a configuration with two latch mechanisms 50. Alternatively, the number of latch mechanisms 50 may be one or more than two.

Figure 8:
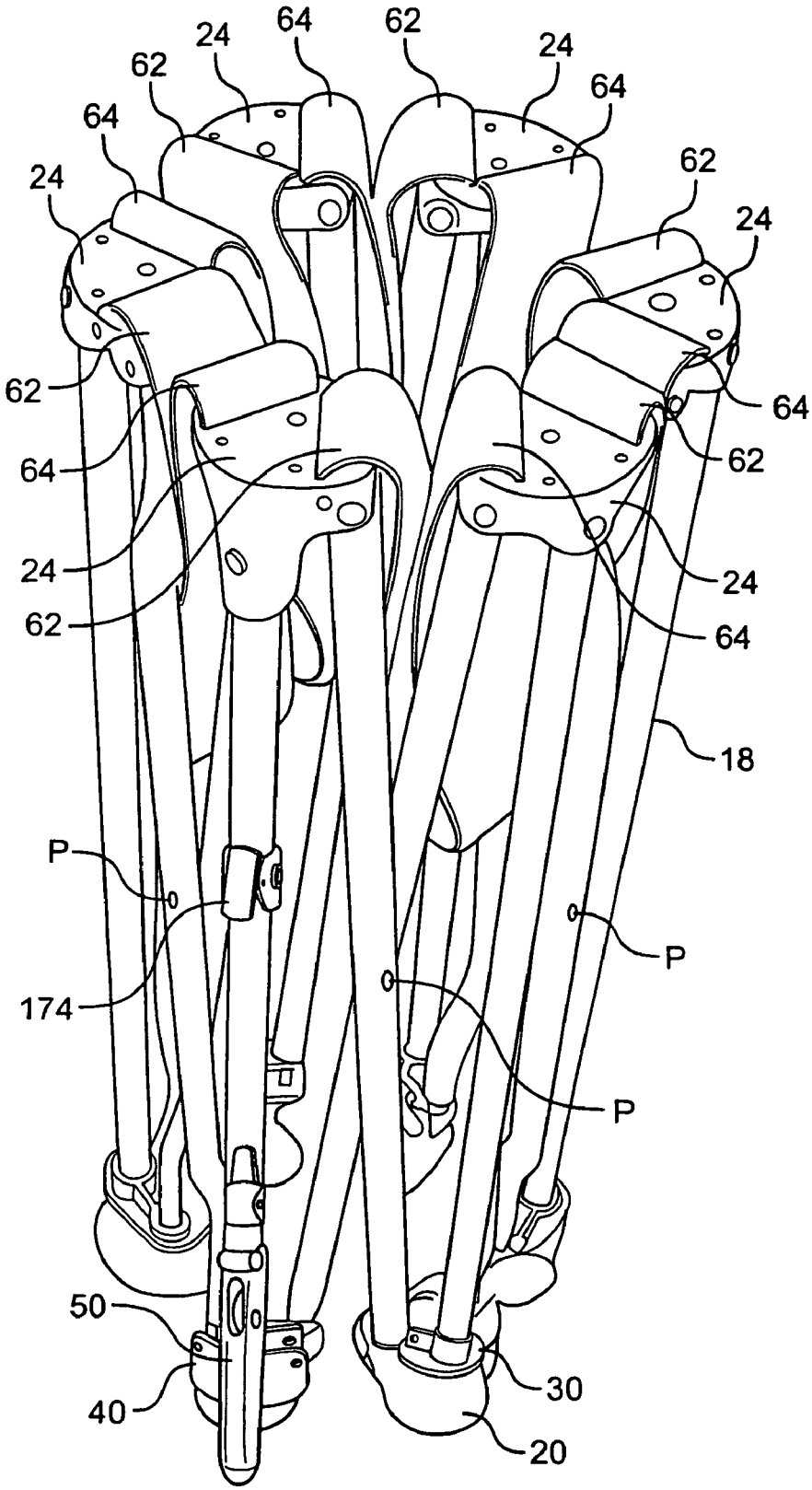
FIG. 8 is a perspective view illustrating a collapsible frame structure in a folded arrangement according to an exemplary embodiment of the present invention.

FIG. 8 illustrates the collapsible frame structure 12 in its folded arrangement. In this arrangement, the cross members 22 are substantially parallel to the legs 18.

The collapsible nature of the collapsible frame structure 12 provides a frame with good portability. The compact fold of the frame structure 12 allows for the frame structure and playard 10 to be readily carried. In the fully open arrangement, the frame structure 12 along with the enclosure 14 provides a large play space.

Figure 9:
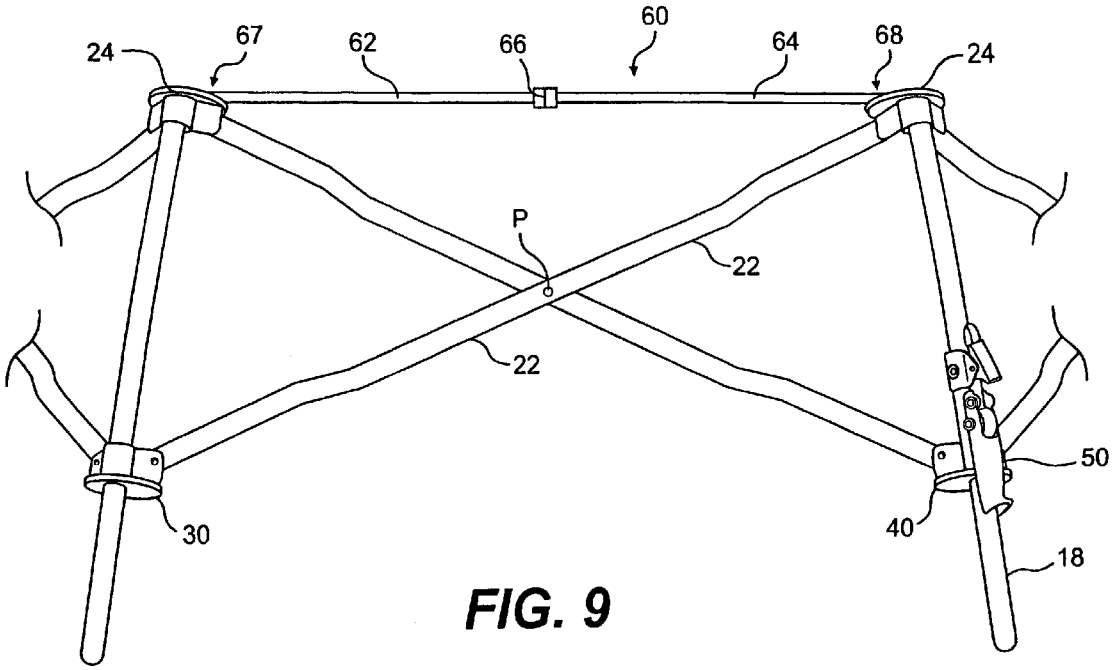
FIG. 9 is a side view illustrating a section of the collapsible frame structure of FIG. 2 with a top rail.

FIG. 9 illustrates a side of the playard 10 with a top rail 60 extending between adjacent legs 18. The playard 10 can include a plurality of top rails 60, each top rail 60 extending between respective adjacent legs 18 and secured to respective pivot joints 24. The top rail 60 provides support for the enclosure 14 when the playard 10 is in the fully open arrangement. When the collapsible frame structure 12 folds to the folded arrangement, each of the top rails 60 folds, allowing the collapsible frame structure 12 to collapse in a compact fashion.

Preferably the top rails 60 are flexible, thus reducing the number of steps required to fold or erect the playard 10. Each top rail 60 may comprise, for example, a strip of fabric material or webbing, which is taut in the open arrangement. Alternatively, each top rail 60 may comprise two stiff sections 62 and 64, respectively, with a fold mechanism 66 intermediate end portions 67 and 68 of the rail 60, separating the two stiff sections 62 and 64, so that the stiff sections may fold when the collapsible frame structure 12 collapses. The fold mechanism may comprise, for example, a hinge, a fold latch, or a simple pivot assembly. Examples of appropriate fold latches are disclosed in, for example, U.S. patent application Ser. No. 09/969,498 entitled "TOP RAIL LATCH FOR FOLDING PLAYARD" filed on Oct. 3, 2001, now abandoned, and published on Apr. 3, 2003 as PG publication No. US 2003/0061658 A1, which is hereby incorporated by reference.

FIG. 17 shows how the top rail 60 can be secured to a pivot joint 24. In this regard, each of the walls 26 of the pivot joint 24 can include an opening 28 into which a pin 29 can be seated. The pin 29 is aligned with slot S that extends through the upper surface of the joint 24. To secure the top rail to the joint 24, the end of the top rail 60 can be threaded through the appropriate slot S and wrapped around the pin 29 and then sewn or otherwise attached to the remainder of the top rail 60, as shown in FIG. 17. Other methods of securing the top rail to a joint 24 also are contemplated by this invention. For example, rather than having a single slot S allocated to receive the end of the top rail 60, the joint 24 can have two parallel slots so that the end of the top rail 60 can be threaded from the upper surface down through the first slot, back up through the second slot, and then secured to the remainder of the top rail 60.

Folding and unfolding the frame structure 12 is now explained with respect to FIGS. 2 and 8. From the open arrangement, a user can release the latching mechanisms 50 to allow the slider joints 40 to freely slide up and down the legs 18. The user than exerts a force on the frame 12 to cause the frame 12 to collapse inwardly. As the force is exerted, the slider joints 30 and 40 slide from the second position P2 to the first position P1, causing cross members 22 to scissor closed. The frame structure 12 is now in the folded arrangement of FIG. 8. To open the frame structure 12, a user exerts a force on the frame structure 12 to cause the frame structure 12 to expand outwardly, and the cross members scissor open. The latching mechanisms 50 are then latched.

Figure 10:
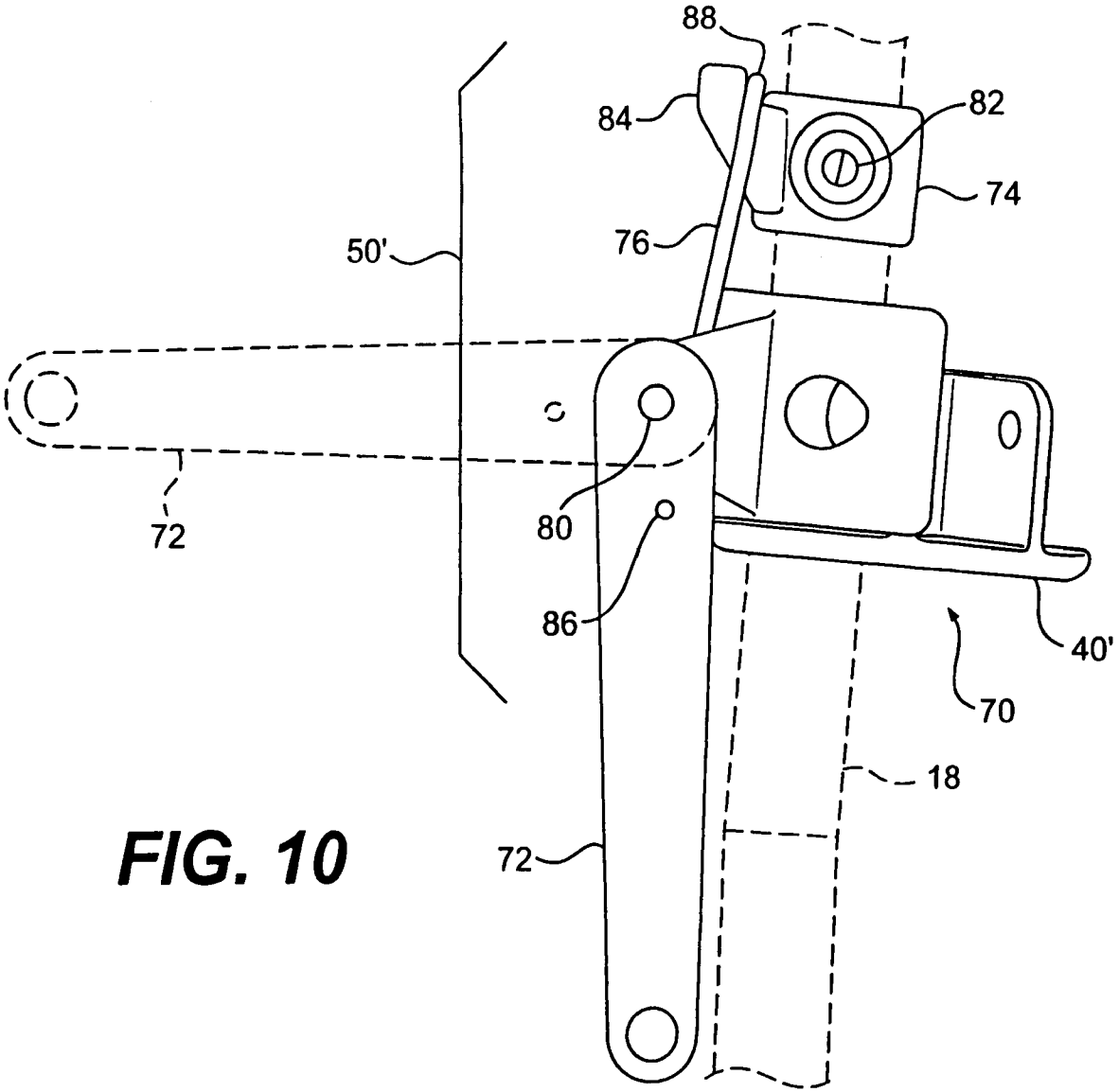
FIG. 10 is a side view illustrating a latch assembly according to an exemplary embodiment of the present invention.

FIG. 10 illustrates one embodiment of a latch assembly 70 for maintaining the playard in an open arrangement. The latch assembly 70 generally includes a slider joint 40' for slidingly engaging a leg 18 of the playard and a latch mechanism 50'. The latch mechanism 50' includes a handle 72, a first latch member 74, and a second latch member 76.

The handle 72 is pivotably attached to the slider joint 40'. In this embodiment of a latch assembly, the handle 72 is attached to the slider joint 40' via a pin 80.

The first latch member 74 is configured to be attached to the leg 18. The first latch member 74 may be fixedly attached to the leg 18 by means of a screw or bolt 82, for example. In this embodiment of the latch assembly, the first latch member 74 is a latch hook and includes a hook portion 84.

The second latch member 76 is attached to the handle 72 and is configured to engage the first latch member 74 to prevent the slider joint 40' from sliding relative to the leg 18. In this embodiment of the latch assembly, the second latch member 76 comprises a bail. The bail 76 is pivotably attached to the handle 72 via a contact portion 86 of the second latch member, where the contact portion 86 extends into the latch handle. A loop portion 88 of the bail 76 can extend over the hook portion 84 of the first latch member 74 to prevent the slider joint 40' from sliding relative to the leg 18.

FIG. 10 illustrates the handle in a first handle position in solid line, where the handle 72 extends in a direction along the leg 18. In the first handle position, the bail 76 engages the hook 84 portion. When the handle 72 is in the second handle position, shown in dashed line, the handle 72 extends in a direction other than along the leg 18. In the second handle position, the bail 76 can be engaged or disengaged with the first latch mechanism. That is, in the second handle position, the bail 76 can be rotated about the contact portion 86 to pass over the hook portion 84.

FIGS. 11-14 illustrate a second embodiment of a latch assembly 170 for maintaining the playard in an open arrangement. The latch assembly 170 generally includes a slider joint 40 for slidingly engaging a leg 18 of the playard and a latch mechanism 50. The latch mechanism 50 of this second embodiment of a latch assembly includes a handle 172, a first latch member 174, and a second latch member 176.

The handle 172 is pivotably attached to the slider joint 40. In this embodiment of the latch assembly, the handle 172 is attached to the slider joint 40 via a pin 180.

The first latch member 174 is configured to be attached to the leg 18. In this embodiment of the latch assembly, the first latch member 174 comprises a toggle mount 182 and a toggle 184. The toggle mount 182 may be fixedly attached to the leg 18 by means of a screw or bolt 186, for example. The toggle 184 is pivotably attached to the toggle mount 182, for example, by a pin 188.

Figure 14:
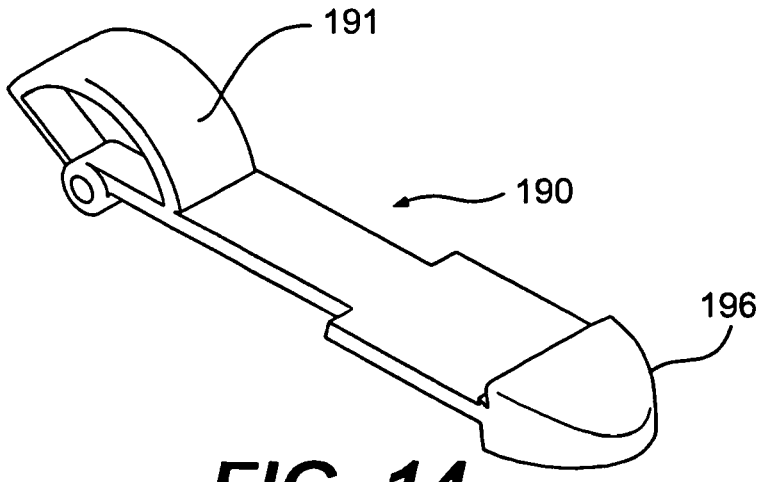
FIG. 14 is a perspective view illustrating a toggle engagement member of the latch assembly according to the exemplary embodiment of FIG. 11.
Figure 13:
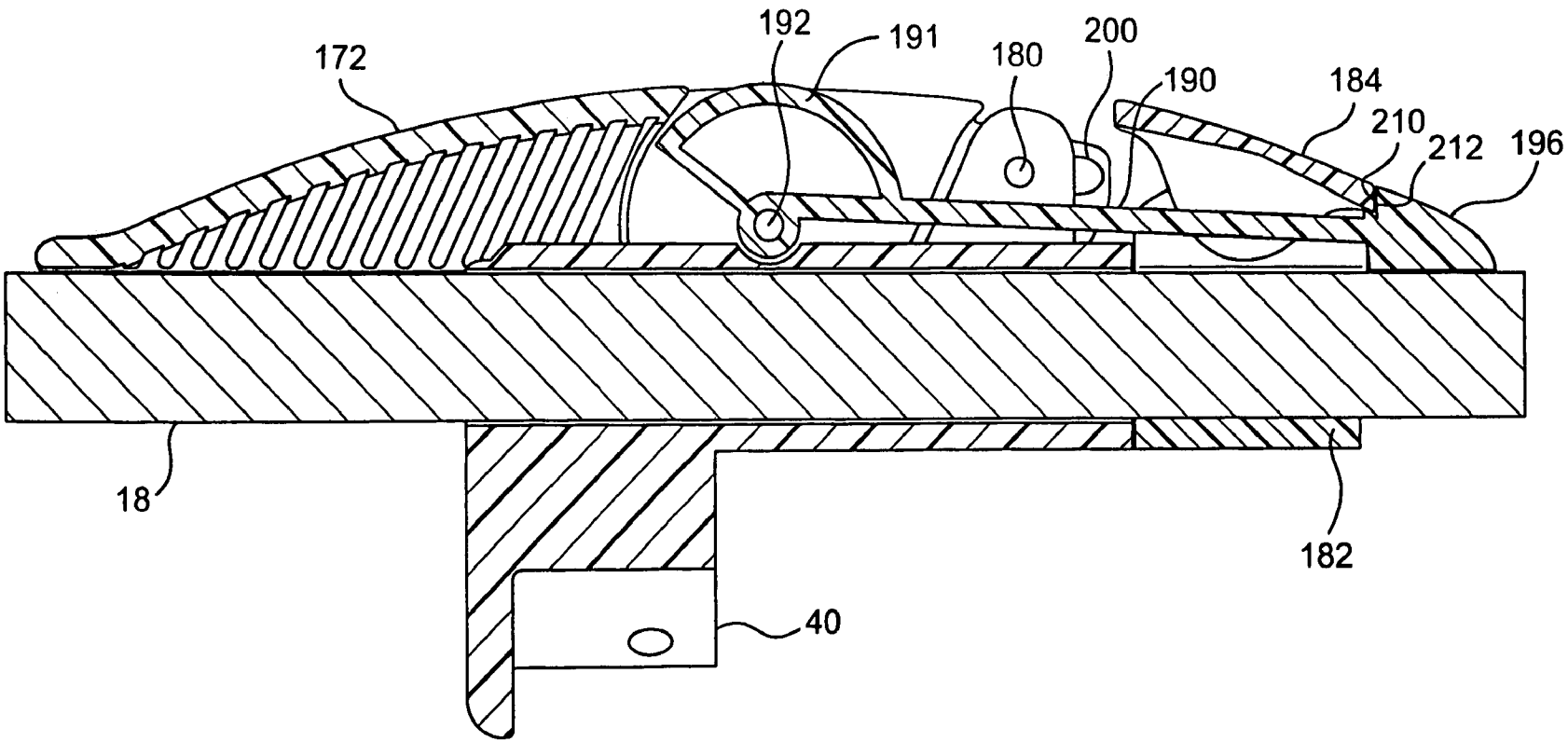
FIG. 13 is a cutaway side view, in partial cross section, illustrating a latch assembly according to the exemplary embodiment of FIG. 11.

The second latch member 176 is attached to the handle 172 and configured to engage the first latch member 174 to prevent the slider joint 40 from sliding relative to the leg 18. In this embodiment, the second latch member 176 comprises a toggle engagement member. The toggle engagement member 176 is pivotably attached to the handle 172 via a pin 192 that extends into the latch handle 172. As shown in FIG. 14, the toggle engagement member 176 includes an arcuate section 191 where the pin 192 is along an axis about which the arcuate section 191 can rotate. The toggle engagement member 176 is configured to slide beyond the toggle 184 to engage the toggle 184 to prevent the slider joint 40 from sliding relative to the leg 18, as shown in FIG. 13. When the toggle engagement member 176 engages the toggle 184, an edge surface 210 of the toggle 184 engages an edge surface 212 of the toggle engagement clip 196.

Figure 12:
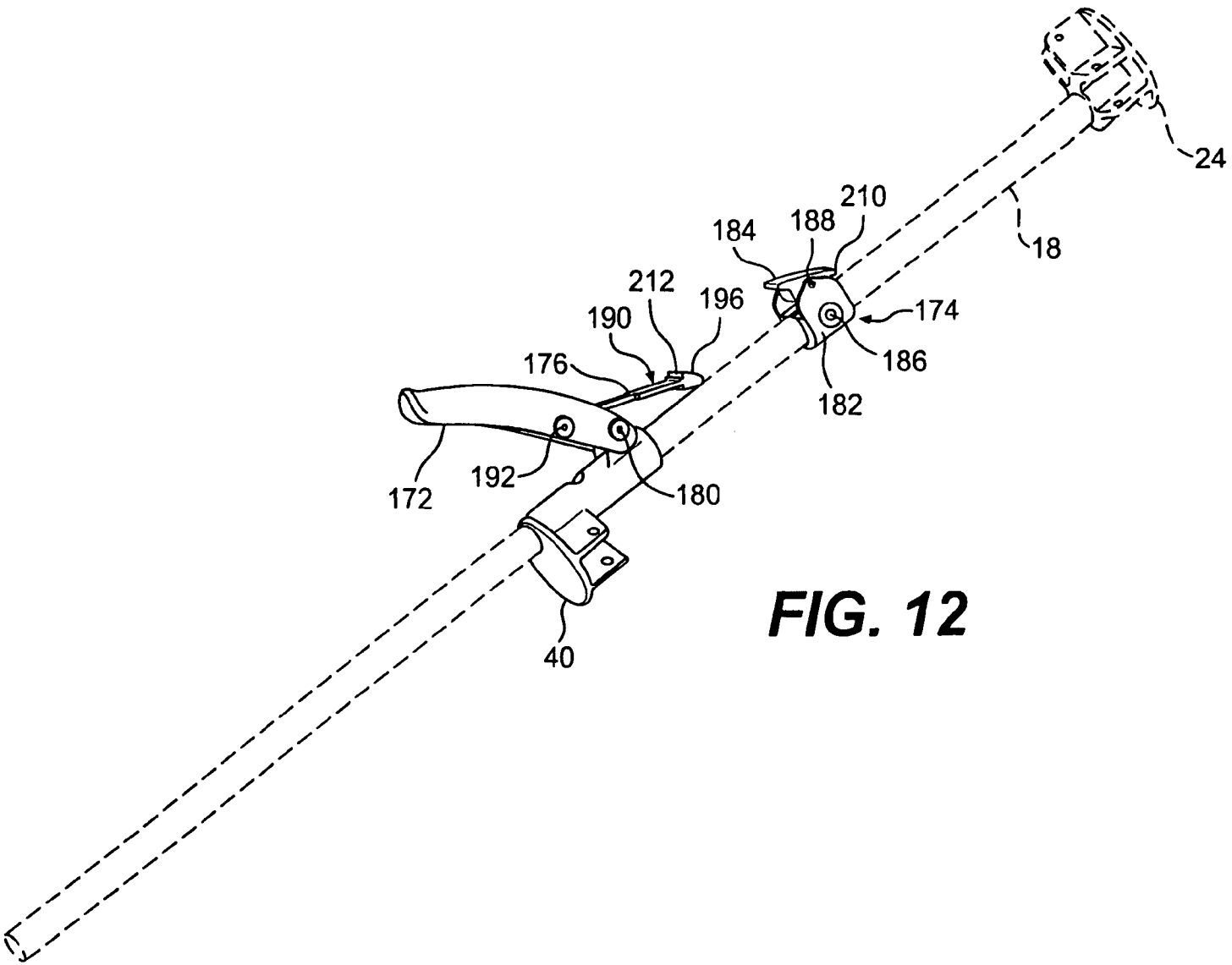
FIG. 12 is a perspective side view illustrating a latch assembly according to the exemplary embodiment of FIG. 11 with the handle in a second handle position.

FIG. 12 illustrates the handle in a second handle position, wherein the handle 172 extends in a direction other than along the leg 18. In the second handle position, the toggle engagement member 176 can move past the toggle 184 by sliding a toggle engagement clip 196 of the toggle engagement member 176 between the toggle 184 and the leg 18. In this regard, the toggle 184 may be in a first toggle position or other positions as the toggle engagement clip 196 slides past a range of positions. Once the toggle engagement clip 196 slides past the toggle 184, the toggle 184 pivots to a second toggle position to engage the clip 196. In this regard, the toggle 184 may be spring biased to bias the toggle 184 towards the second toggle position shown in FIG. 12.

Figure 11:
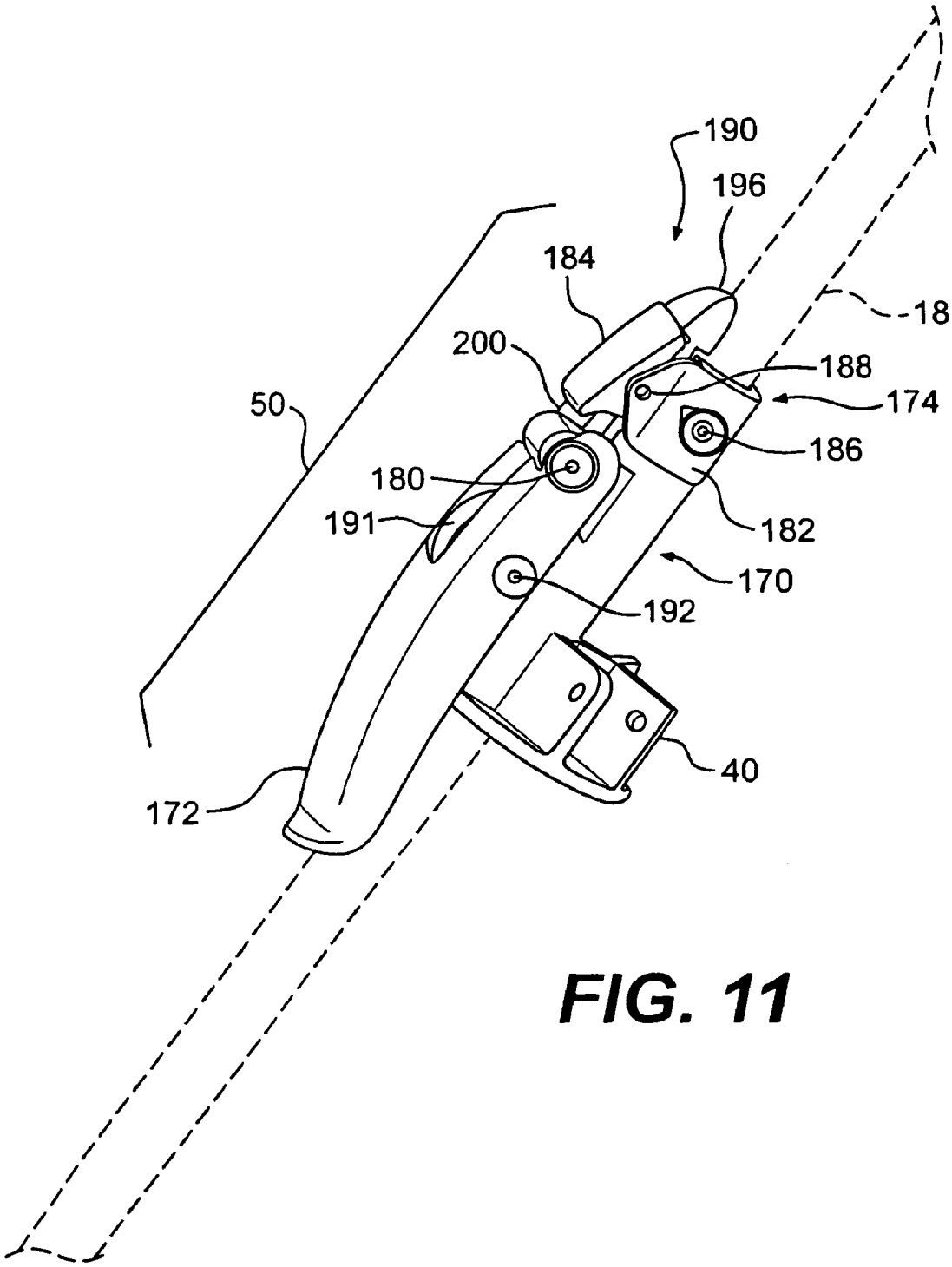
FIG. 11 is a perspective view illustrating a latch assembly according to another exemplary embodiment of the present invention with the handle in a first handle position.

In the first handle position shown in FIGS. 11 and 13, the handle 172 extends in a direction along the leg 18. When the handle 172 is in this position, the toggle engagement member 176 remains engaged with the toggle 184. In this regard, the handle includes at least one protrusion, or nub, 200 which prevents toggle 184 from rotating to the first toggle position to disengage the toggle engagement clip 196, absent movement of handle.

Figure 15:
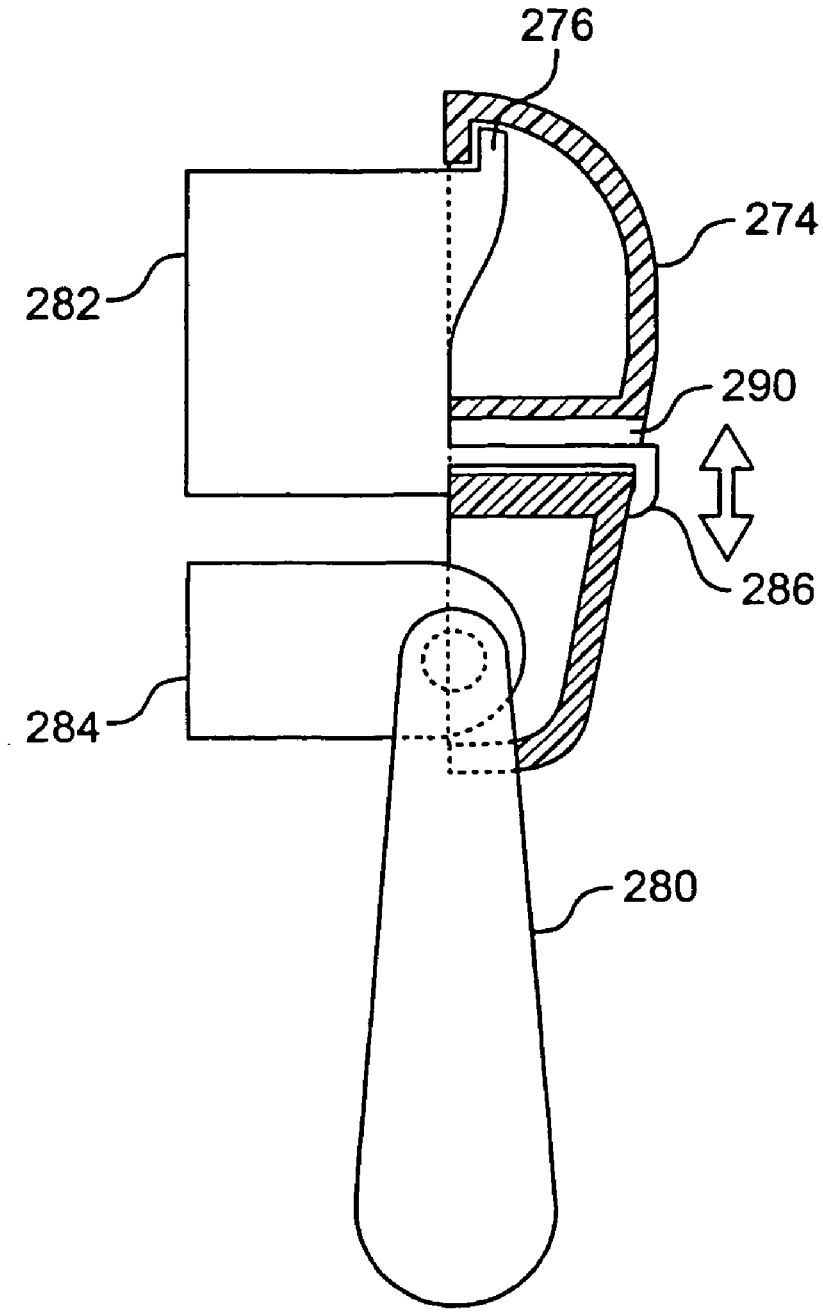
FIG. 15 is a side view, in partial cross-section, illustrating a latch assembly according to an exemplary embodiment of the present invention.
Figure 16:
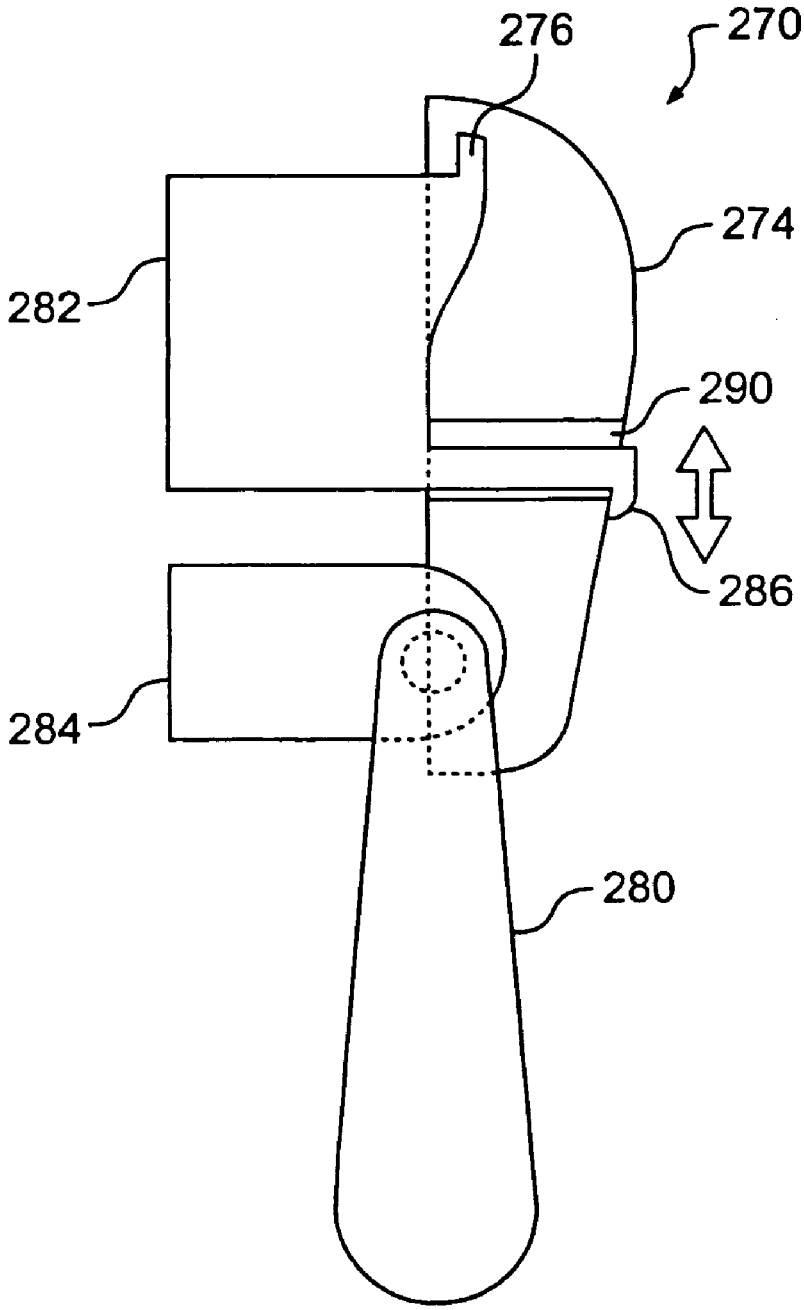
FIG. 16 is a side view illustrating a latch assembly according to the exemplary embodiment of FIG. 15.

FIGS. 15 and 16 are side views, with FIG. 15 in partial cross-section, illustrating a latch assembly 270 according to another exemplary embodiment of the invention. This latch assembly 270 provides a secondary lock. The latch assembly 270 includes a latch member 282, a hook 276, and a spring finger 286. The latch member 282 may be fixed relative to a leg of the frame structure. The latch assembly 270 also includes a bail 274 attached to slider joint 284, and a handle 280 pivotably mounted to the slider joint 284. Slider joint 284 can be configured like slider joint 40 of FIG. 10. FIGS. 15 and 16 illustrate the handle 280 in a position such that the bail 274 is looped over the hook 276 to engage the hook 276. The spring finger 286 passes through a hole 290 in the bail 274 to contact and engage an outside surface of a lower portion of the bail 274. The engagement of the hook 276 and bail 274 provide a first lock, and the engagement of the snap finger 286 and the bail 274 provide a second lock. In FIG. 16, the upward arrow indicates the motion that a thumb or finger would take in pushing up the spring finger 286 to release the finger 286 from the bail 274, so that the bail 274 may be disengaged from the hook 276 using the handle 280.

Figure 3:
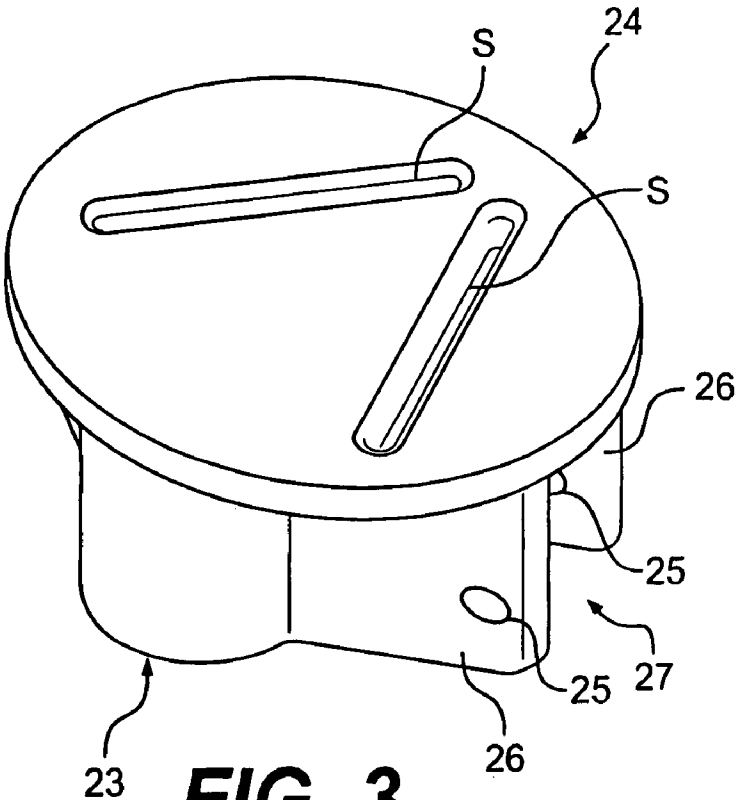
FIG. 3 is a perspective view illustrating a pivot joint of the collapsible frame structure of FIG. 2.
Figure 18:
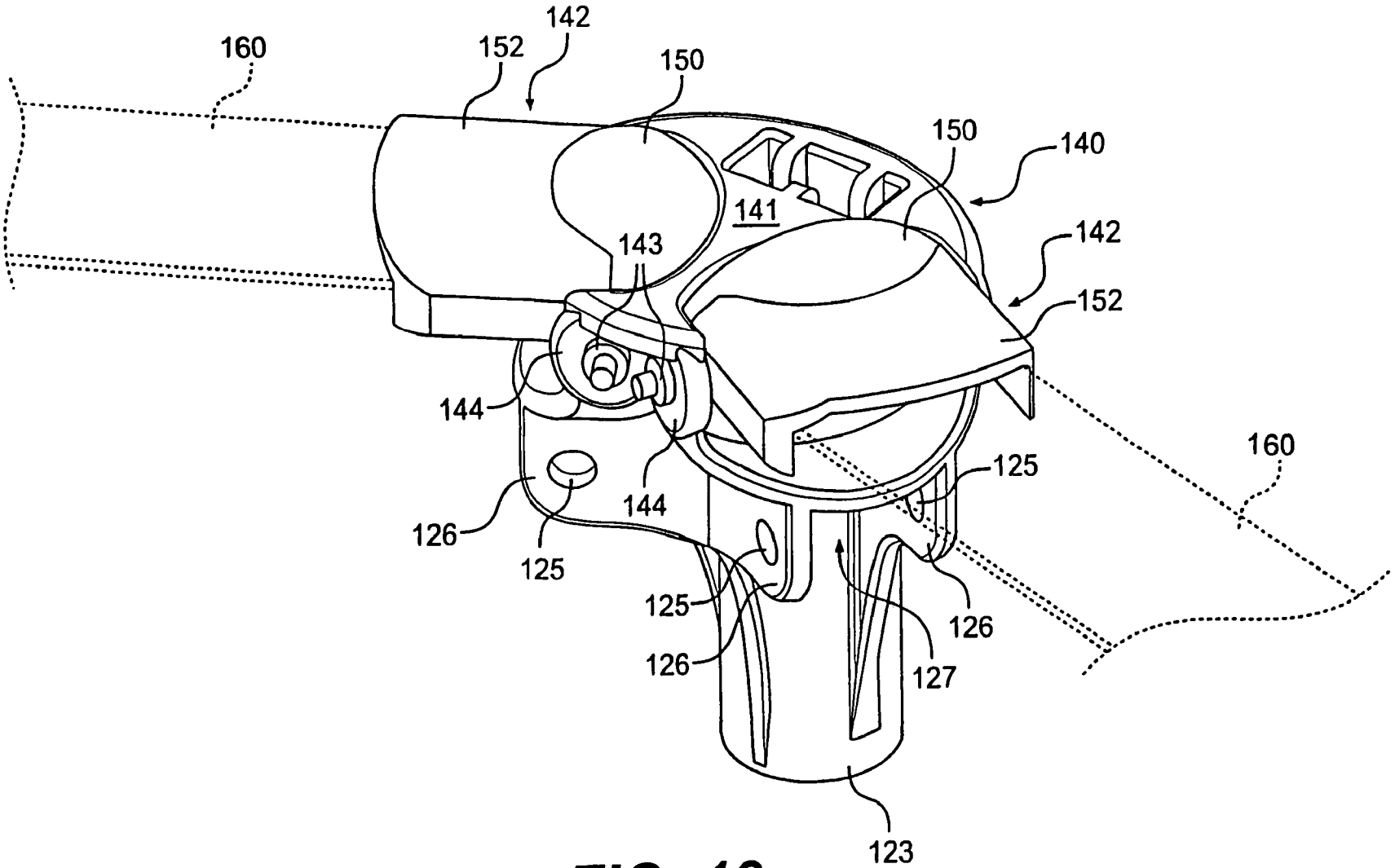
FIG. 18 is a top perspective view of an alternative pivot joint suitable for use with the present invention.
Figure 19:
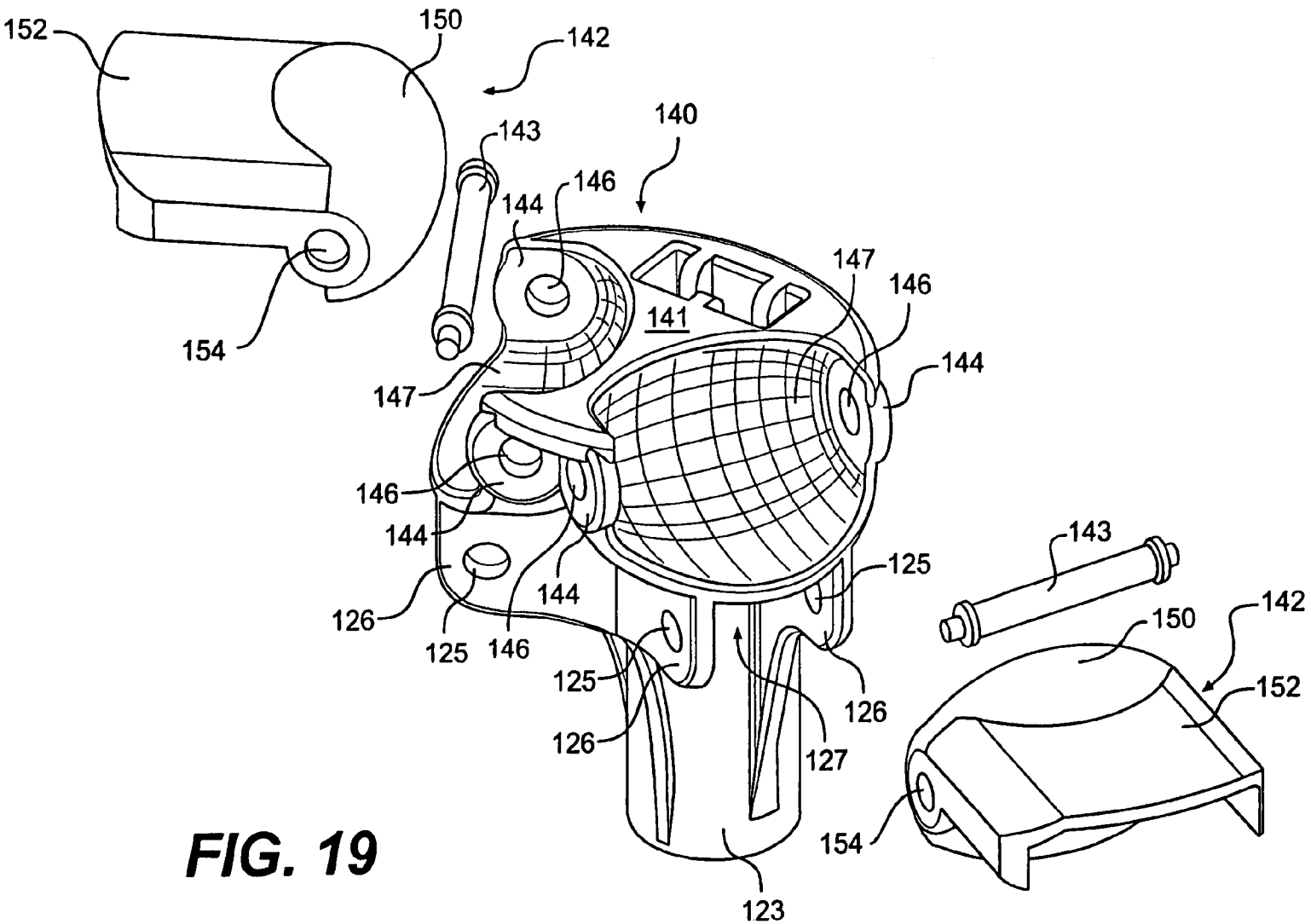
FIG. 19 is an exploded view of the pivot joint of FIG. 18.

FIGS. 18-19 illustrate an alternative pivot joint 140 to the pivot joint 24 shown in FIGS. 3, 4, and 17. The pivot joint 140 is arranged on an upper end of a respective leg 18. In this regard, the leg 18 can fit into a recess in a stem 123 of the pivot joint 124. At least one, and preferably two, cross members 22 also are attached to the pivot joint 140. That is, the pivot joint 140 has walls 126, and an end of a cross member 22 can be positioned within a recess 127 defined by adjacent walls 126. The end of a cross member 22 can be pivotally secured in the respective recess 127 by a pin (not shown) that passes through holes 125 in walls 126 and through the end of the cross member 22.

In a playard employing pivot joints 140, each top rail 60 can include top rail webbing 160 and top rail extensions 142 at either end of the webbing 160. FIG. 18 shows a pair of top rail extensions 142 associated with adjacent top rails 60 that are pivotally connected to the pivot joint 140 by a pair of pivots, such as pins 143. In this regard, the pivot joint 140 also includes extension-receiving areas 147, each bounded by a pair of opposed mounts 144. The mounts 144 each have a hole 146 for receipt of the respective pin 143. The top rail extensions 142 in turn each have a head portion 150 that fits within a respective extension-receiving area 147 of the pivot joint 140. The head portion 150 of each extension 142 includes a pair of holes 154 that align with the holes 146 of the mounts 144 to receive the pin 143. The head portion 150 of the extension 142 can be curved, and the extension-receiving area 147 can be concave to correspond snugly with the curve of the head portion 150.

The top rail extensions 142 also include a flange 152. When the playard 10 is in the fully open arrangement, the flange 152 extends from a surface of the head portion 150 in a direction generally corresponding to the respective top rail 60, as shown in FIG. 18. The top rail webbing 160 can be secured to pin 143 or to the top rail extension 142. For example, an end of the top rail webbing 160 can be looped around pin 143 and then sewn, or otherwise secured, to a remainder of the webbing 160. Alternatively, the head portion 150 can include a hollow shaft (not shown) that extends between holes 154 to receive pin 143, and an end of the top rail webbing 160 can be looped around the shaft and then sewn, or otherwise secured, to a remainder of the webbing 160. In another arrangement, the end of the top rail webbing 160 can be sewn or otherwise secured directly to the head portion 150 or to the flange 152 of the extension 142. For example, the flange 152 can include a slot (not shown) therethrough that extends from its upper surface to its lower surface, and an end of the top rail webbing 160 can be threaded through and wound around the slot and sewn to a remainder of the webbing 160. In this manner, the top rail webbing 160 can be secured directly to the flange 152 of the top rail extension 142.

Figure 20:
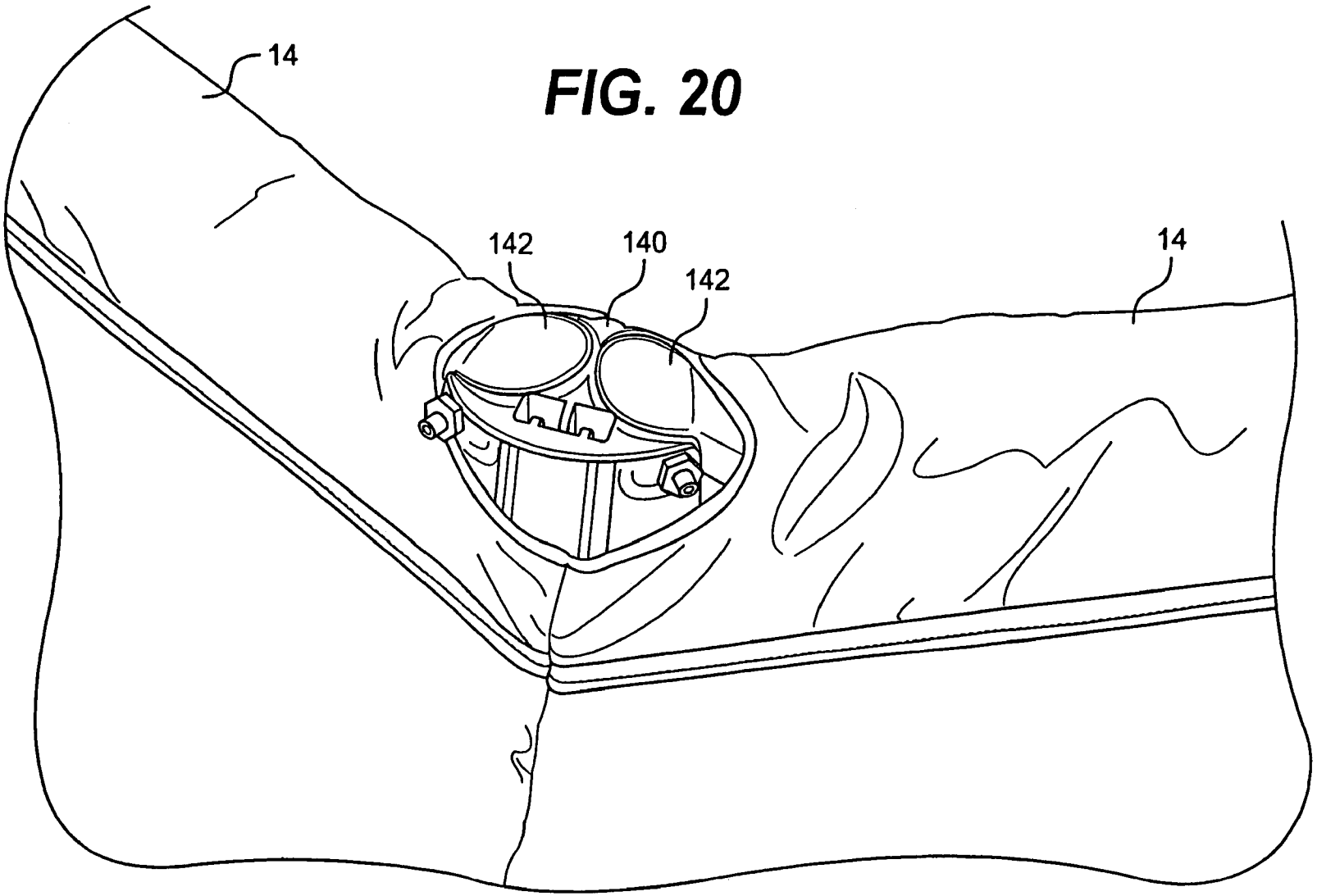
FIG. 20 is a top perspective view of the pivot joint area of a playard, where the playard includes the pivot joint of claim 18.

FIG. 20 shows the pivot joint area of a playard 10 that employs a pivot joint 140. In this embodiment, pivot joint 140 is exposed. In other embodiments, such as the embodiment of FIG. 1, the pivot joint can be covered by the fabric enclosure 14.

In addition, FIG. 20 shows the fabric enclosure 14 supported by the top rail webbing 160, which is hidden by the enclosure 14 in this figure, and at least partially supported by the top rail extensions 142. In this regard, when the playard 10 is in the fully open arrangement, the fabric enclosure 14 is partially supported by the flanges 152 of the extensions 142. When the playard 10 is collapsed to the folded arrangement, the top rail extensions 142 can pivot downward, toward the feet 20 of the playard 10, essentially together with the top rail webbing 161. When the extensions 142 are pivoted downward, the fabric enclosure 14 remains in contact with, and partially supported on, the flanges 152 of the extensions 142, and, consequently, the hole in the fabric enclosure 14 around the pivot joint 140 remains centered relative to the pivot joint 140. Thus, shifting of the fabric enclosure 14 along the top rails 60 and over the pivot joint 140 is prevented.

Figure 21:
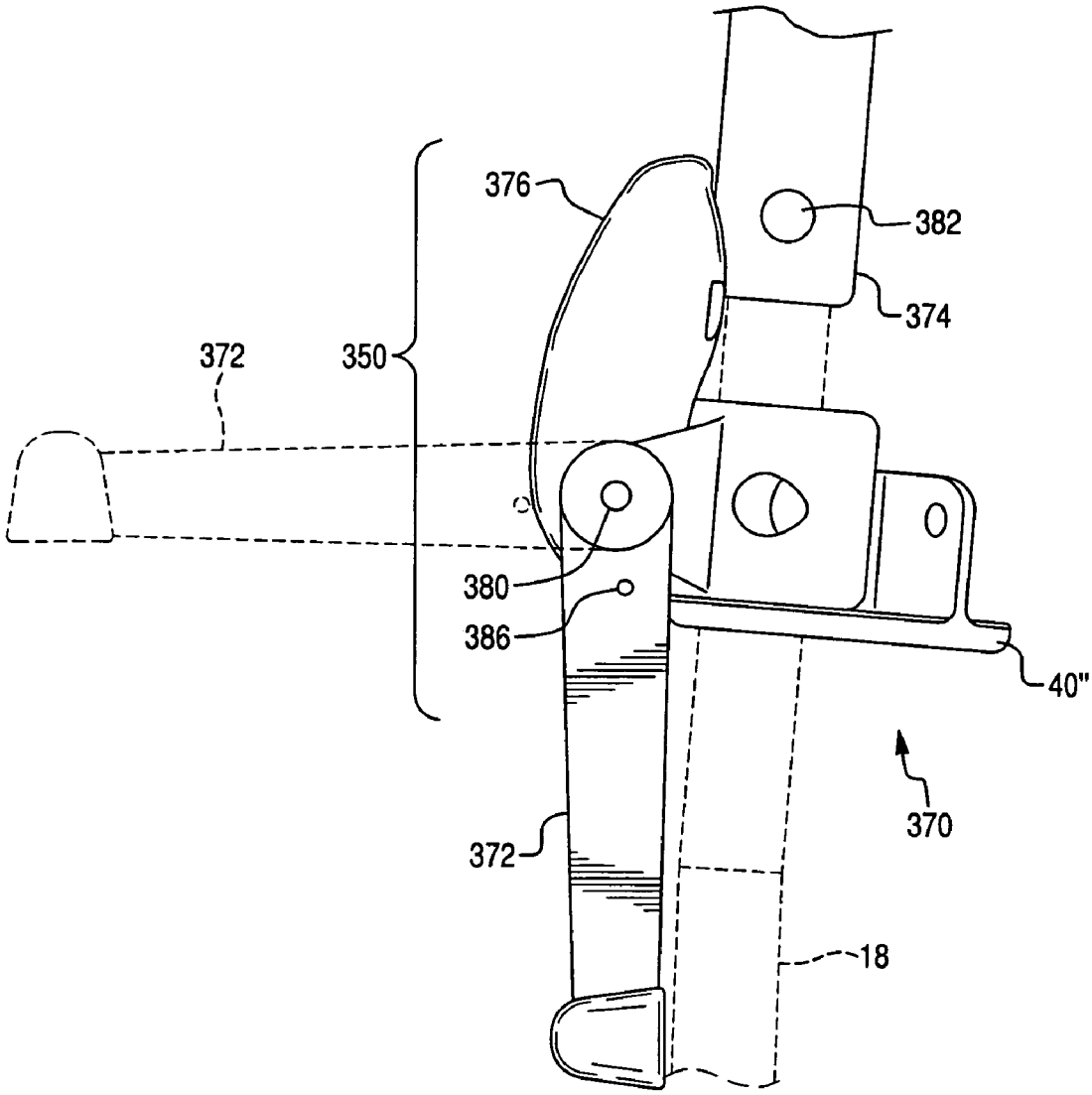
FIG. 21 is a side view illustrating a latch assembly according to another exemplary embodiment of the present invention.
Figure 22:
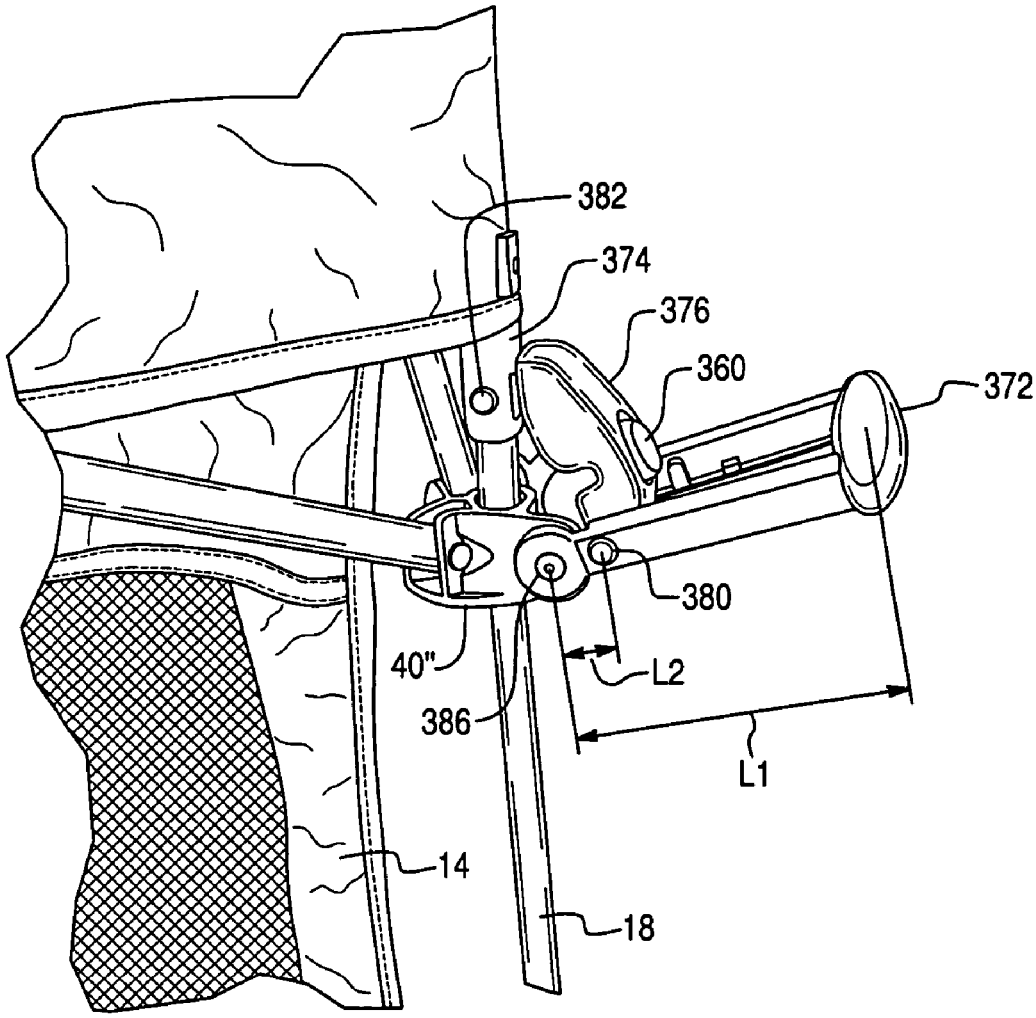
FIG. 22 is a perspective view of the latch assembly of FIG. 21.
Figure 23:
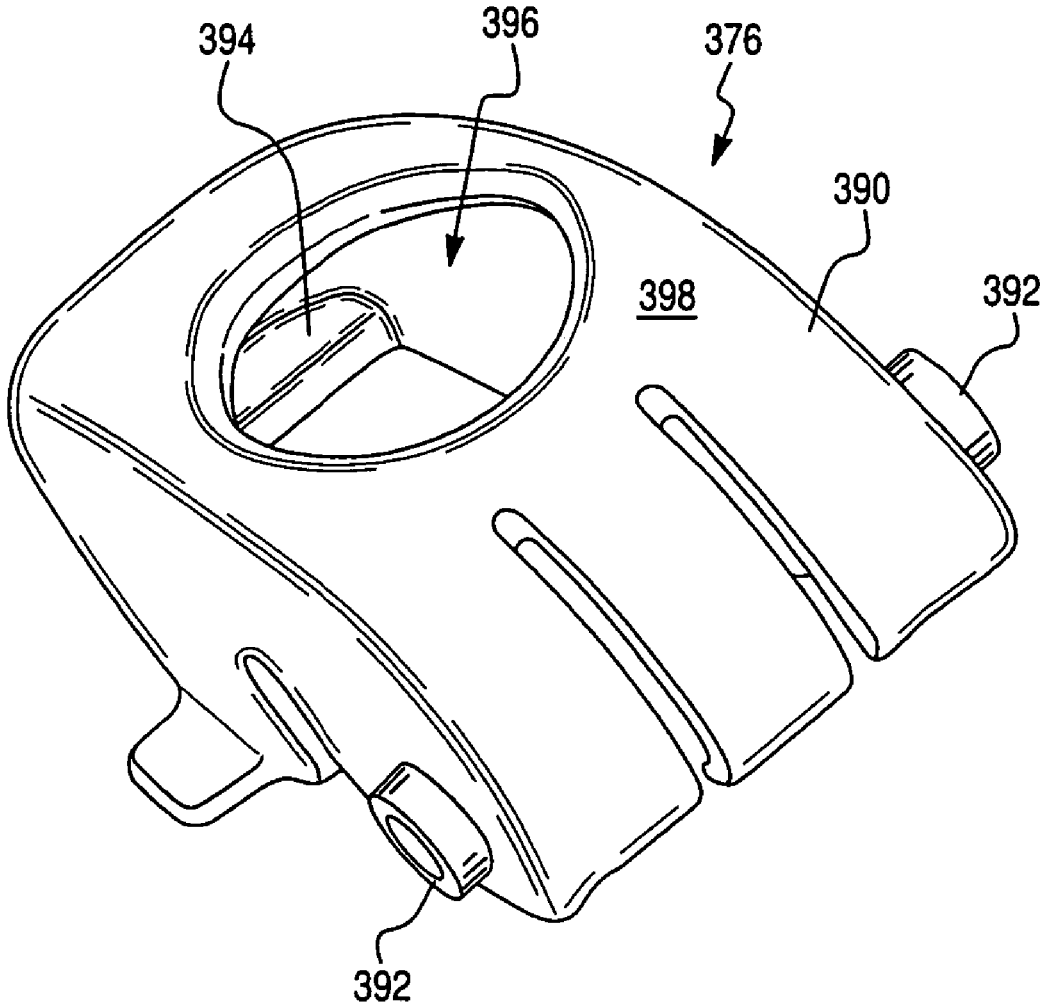
FIG. 23 is a perspective view of the bail of the latch assembly of FIG. 21.

FIGS. 21-23 illustrate another exemplary embodiment of a latch assembly 370 for maintaining the playard in an open arrangement. This latch assembly 370 is similar to the latch assembly 70 of FIG. 10. The latch assembly 370 generally includes a slider joint 40' for slidingly engaging a leg 18 of the playard and a latch mechanism 350. The latch mechanism 350, when latched, prevents movement of the collapsible frame assembly from an open arrangement to a folded arrangement. The latch mechanism 350 includes a handle 372, a first latch member 374, and a second latch member 376.

The handle 372 is pivotably attached to the slider joint 40". In this embodiment of a latch assembly, the handle 372 is attached to the slider joint 40" via a pin 380.

The first latch member 374 is configured to be attached to the leg 18. The first latch member 374 may be fixedly attached to the leg 18 by means of a screw or bolt 382, for example. In this embodiment of the latch assembly, the first latch member 374 is a latch hook and includes a hook portion (not visible, but similar to hook portion 84 of FIG. 10).

The second latch member 376 is attached to the handle 372 and is configured to engage the first latch member 374 to prevent the slider joint 40" from sliding relative to the leg 18. In this embodiment of the latch assembly, the second latch member 376 comprises a bail. The bail 376 is pivotably attached to the handle 372 via a fastener(s) 386 that extend through the latch handle 372 and into engagement with the bail 376 at fastener collars 392. The bail 376 has a housing 390 with a shelf 394 on an interior of the housing 390, as seen in FIG. 23. The shelf 394 can extend over the hook portion of the first latch member 374 to prevent the slider joint 40" from sliding relative to the leg 18. The housing 390 also has an aperture 396 through its outer face 398 that can display a manufacturer's emblem 360, for example, as seen in FIG. 22. The housing 390 further can have a pair of side tabs that prevent the bail 376 from rotating between the side arms of the handle 372.

FIG. 21 illustrates the handle 372 in a first handle position in solid line, where the handle 372 extends in a direction along the leg 18. In the first handle position, the bail 376 engages the hook portion of the first latch member 374. When the handle 372 is in the second handle position, shown in dashed line, the handle 372 extends in a direction other than along the leg 18. In the second handle position, the bail 376 can be engaged or disengaged with the first latch member 374. That is, in the second handle position, the bail 376 can be rotated about the fasteners 386 to pass over the hook portion 384 of the first latch member 374.

FIG. 22 illustrates the mechanical advantage afforded by the latching assembly 370. The latch mechanism 350 provides a fulcrum at pin 380 and two lever lengths L1, L2, which enable a user to apply little force to the latch mechanism 350 to tighten the fabric enclosure 14 over the playard frame. In one embodiment, for example, the latch mechanism 350 provides the user with a 4.75/1 mechanical advantage (every 1 lb of force applied at the end of the handle 372 translates to 4.75 lbs of force at the latched engagement of the bail 376 to the first latch member 374). The mechanical advantage ratio can be adjusted by altering the ratio of L1 to L2. Thus, the latch mechanism 350 allows the user to easily manipulate the handle 372 and bail 376 to latch the playard in the fully open arrangement.

Figure 24A:
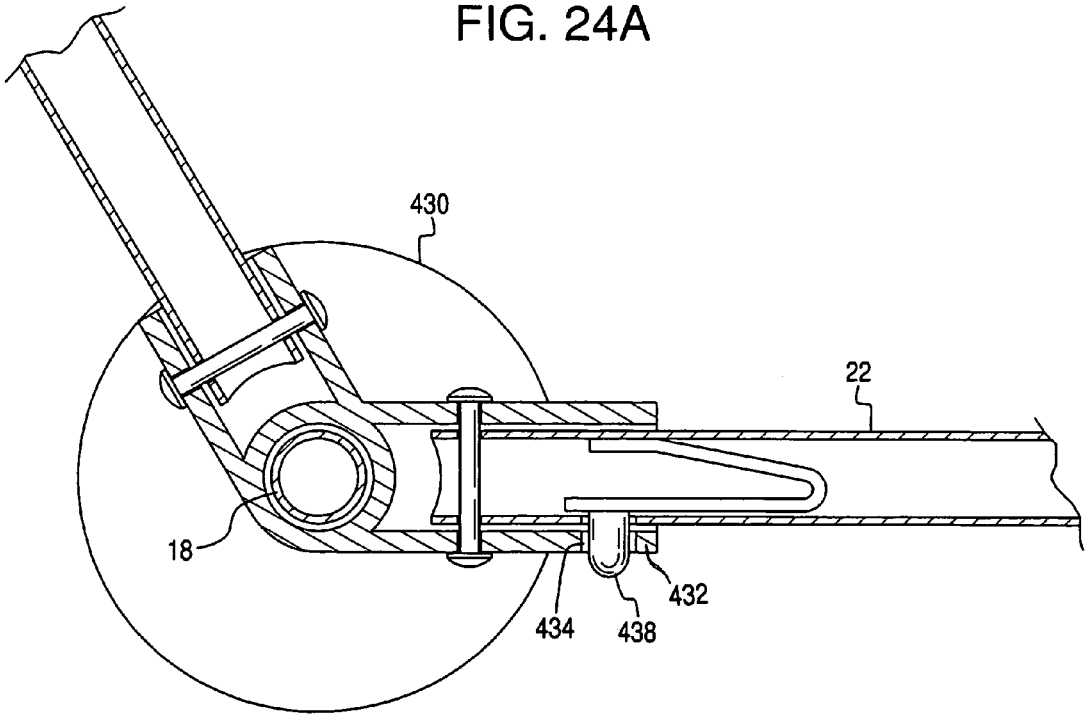
FIG. 24A is a cross section of the latch assembly of FIG. 24.
Figure 25:
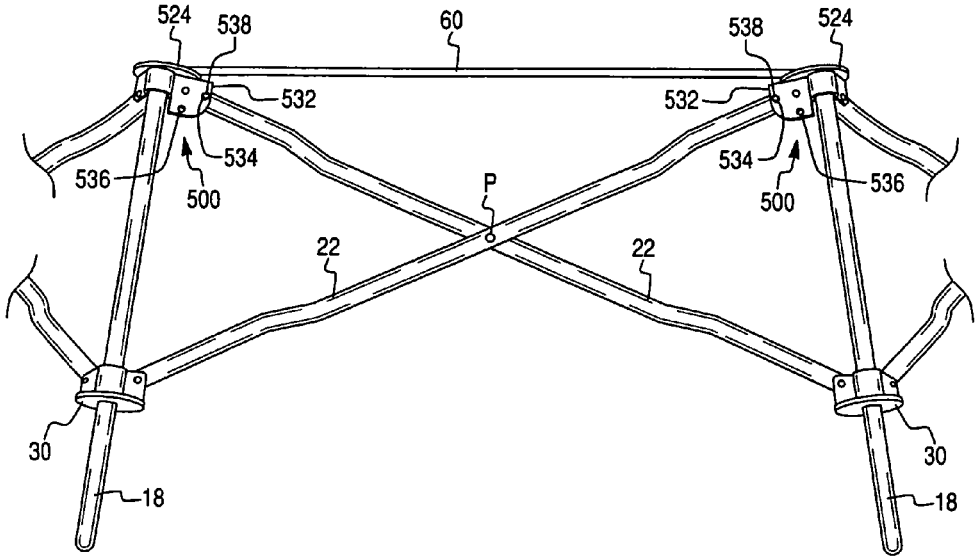
FIG. 25 is a side view illustrating a section of a collapsible frame structure having still another exemplary latch assembly in accordance with the present invention.
Figure 26:
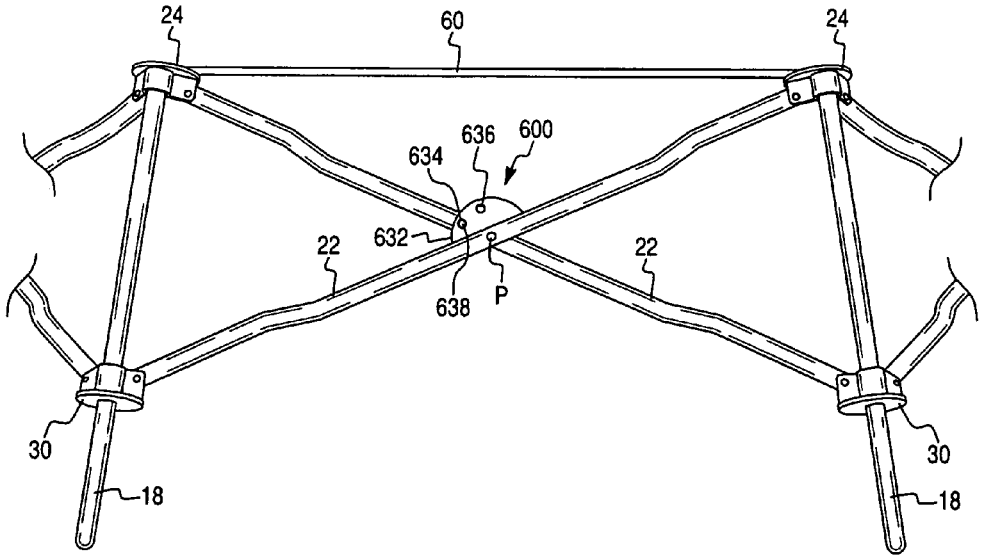
FIG. 26 is a side view illustrating a section of a collapsible frame structure having yet another exemplary latch assembly in accordance with the present invention.

FIGS. 24-26 illustrate other exemplary latch mechanisms suitable for use on a collapsible frame structure for a playard. FIGS. 24 and 24A show a latch mechanism 400 associated with a slider joint 430; FIG. 25 shows a latch mechanism 500 associated with a pivot joint 524; and FIG. 26 shows a latch mechanism 600 associated with the pivot P that connects each pair of cross members 22. These latch mechanisms, when latched, prevent movement of the collapsible frame assembly from an open arrangement to a folded arrangement.

As shown in FIG. 24, the latch mechanism 400 includes a latch plate 432 that is coupled to the slider joint 430. The latch plate 432 may be formed as part of a wall of the slider joint 430 (for example, a wall 44 of slider joint 40 of FIG. 7 may be made larger and re-shaped), as shown in FIG. 24, or, alternatively, the latch plate 432 may be made separate from, and then attached to, the wall of the slider joint 430. The latch plate 430 includes two apertures 434, 436, and the cross member 22 that is pivotally coupled to the slider joint 430 includes a button 438, such as a Valco snap button, that can releasably engage either of the two apertures 434, 436. FIG. 24A shows these structures in cross section. The first aperture 434 is positioned on the plate 432 so that, when the cross member 22 is in the fully open position (corresponding to the fully open arrangement of the collapsible frame structure of the playard), the snap button 438 can engage the first aperture 434. The second aperture 436 is positioned on the plate 432 so that, when the cross member 22 is in the folded position (corresponding to the folded arrangement of the collapsible frame structure of the playard), the snap button 438 can engage the second aperture 436. The snap button 438 is biased outward relative to the cross member 22; however, the snap button 438 may be depressed to clear the latch plate 432, allowing pivoting of the cross member 22 from the open position to the folded position or vice versa. This latch mechanism 400, which includes the latch plate 432 and the snap button 438, enables locking of the cross member 22 at a predefined angle in the fully open, deployed position and locking of the cross member 22 in the folded position.

Although the latch mechanism 400 is shown in FIG. 24 in association with both slider joints 430 of one side of the collapsible frame structure, it will be understood that the latch mechanism 400 can be employed at only one, select ones, or all of the slider joints 430. The collapsible frame structure need only include one latch mechanism 400 at one slider joint 430 to lock the collapsible frame structure in its open arrangement. Also, in alternative embodiments, the latch plate 432 can include only the first aperture 434 to provide locking capability in only the fully open arrangement, or the latch plate 432 can include only the second aperture 436 to provide locking capability in only the folded arrangement. Locking the cross members 22 in the folded arrangement may facilitate portability of the playard.

FIG. 25 shows latch mechanisms 500 associated with pivot joints 524. Each latch mechanism 500 includes a latch plate 532 that is coupled to the respective pivot joint 524. The latch plate 532 may be formed as part of a wall of the pivot joint 524 (for example, a wall 26 of pivot joint 24 of FIGS. 3 and 4 may be made larger and re-shaped), as shown in FIG. 25, or, alternatively, the latch plate 532 may be made separate from, and then attached to, the wall of the pivot joint 524. Like latch plate 432, latch plate 532 includes two apertures 534, 536, and the cross member 22 that is pivotally coupled to the pivot joint 524 includes a button 538, such as a Valco snap button, that can releasably engage either of the two apertures 534, 536. The first aperture 534 is positioned on the plate 532 so that, when the cross member 22 is in the fully open position (corresponding to the fully open arrangement of the collapsible frame structure of the playard), the snap button 538 can engage the first aperture 534. The second aperture 536 is positioned on the plate 532 so that, when the cross member 22 is in the folded position (corresponding to the folded arrangement of the collapsible frame structure of the playard), the snap button 538 can engage the second aperture 536. The snap button 538 is biased outward relative to the cross member 22; however, the snap button 538 may be depressed to clear the plate 532, allowing pivoting of the cross member 22 from the open position to the folded position or vice versa. This latch mechanism 500, which includes the latch plate 532 and the snap button 538, enables locking of the cross member 22 at a predefined angle in the fully open, deployed position and locking of the cross member 22 in the folded position.

Although the latch mechanism 500 is shown in FIG. 25 in association with both pivot joints 524 of one side of the collapsible frame structure, it will be understood that the latch mechanism 500 can be employed at only one, select ones, or all of the pivot joints 524. The collapsible frame structure need only include one latch mechanism 500 at one pivot joint 524 to lock the collapsible frame structure in its open arrangement. Also, in alternative embodiments, the latch plate 532 can include only the first aperture 534 to provide locking capability in only the fully open arrangement, or the latch plate 532 can include only the second aperture 536 to provide locking capability in only the folded arrangement.

FIG. 26 shows a latch mechanism 600, similar in operation to latch mechanisms 400, 500, in association with the pivot P connecting a pair of cross members 22. The latch mechanism 600 includes a latch plate 632 that can be coupled to the pivot P and one of the cross members 22 (the other cross member 22 being lockable to the latch plate 632) or at the pivot P between the cross members 22. The latch plate 632 includes two apertures 634, 636, and the cross member 22 that locks to the latch plate 632 includes a button 638, such as a Valco snap button, that can releasably engage either of the two apertures 634, 636. The first aperture 634 is positioned on the plate 632 so that, when the cross member 22 is in the fully open position (corresponding to the fully open arrangement of the collapsible frame structure of the playard), the snap button 638 can engage the first aperture 634. The second aperture 636 is positioned on the plate 632 so that, when the cross member 22 is in the folded position (corresponding to the folded arrangement of the collapsible frame structure of the playard), the snap button 638 can engage the second aperture 636. The snap button 638 is biased outward relative to the cross member 22; however, the snap button 638 may be depressed to clear the plate 632, allowing pivoting of the cross member 22 from the open position to the folded position or vice versa. This latch mechanism 600, which includes the latch plate 632 and the snap button 638, enables locking of the cross member 22 at a predefined angle in the fully open, deployed position and locking of the cross member 22 in the folded position.

This latch mechanism 600 can be employed at each side of the playard or only at selected sides of the playard. Also, in alternative embodiments, the latch plate 632 can include only the first aperture 634 to provide locking capability in only the fully open arrangement, or the latch plate 632 can include only the second aperture 636 to provide locking capability in only the folded arrangement. In still a further embodiment, the latch plate 632 can include a pair of first apertures 634, one per cross member 22, and/or a pair of second apertures 634, one per cross member 22, to provide locking capability to both cross members 22 in association with the pivot P.

Figure 27:
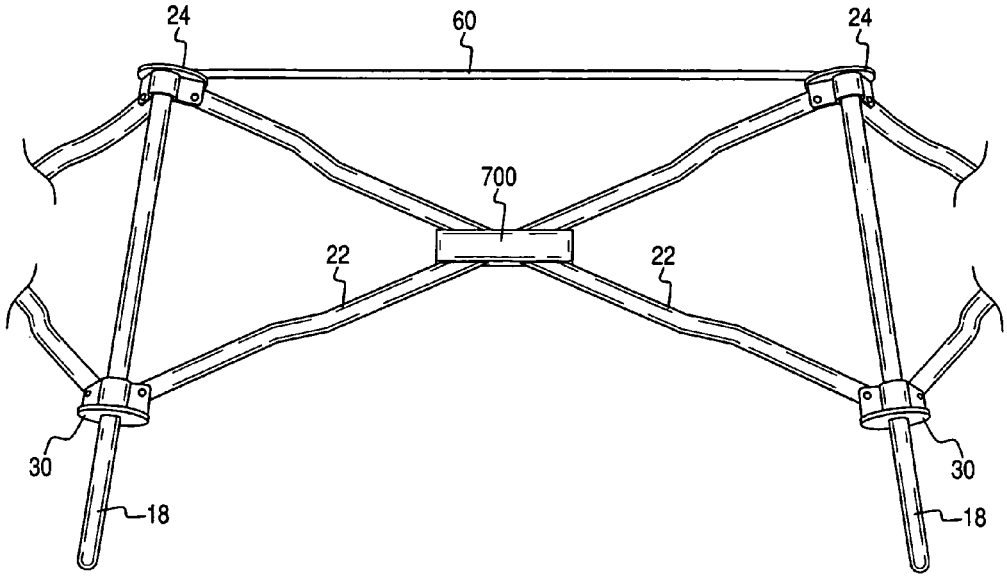
FIG. 27 is a side view illustrating a section of a collapsible frame structure having a further exemplary latch assembly in accordance with the present invention.

Another latch mechanism that can be used to lock the cross members 22 of the playard in a predefined open position is shown in FIG. 27. The latch mechanism comprises a retaining member, such as a plastic retaining block 700, positioned at the pivot P between the cross members 22 and encircling the pivot P. The block 700 prevents the cross members 22 from pivoting past a predefined angle in the fully open, deployed position. This block 700 provides a passive latch that does not need to be actuated in order to fold the playard. In addition, the block 700 remains mounted to the pivot P in both the open arrangement and the folded arrangement of the collapsible frame structure.

Figure 28:
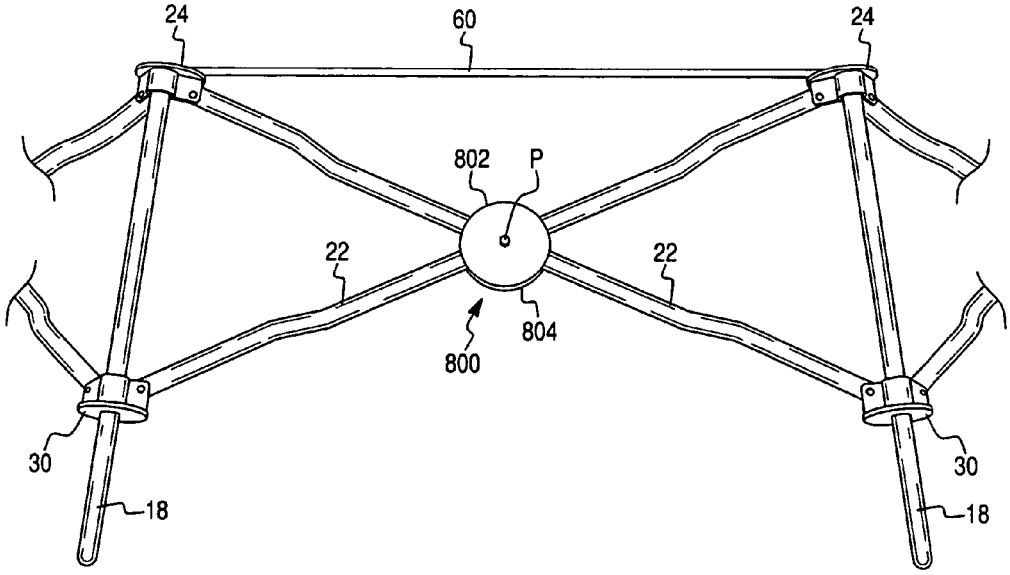
FIG. 28 is a side view illustrating a section of a collapsible frame structure having still a further exemplary latch assembly in accordance with the present invention.
Figure 28A:
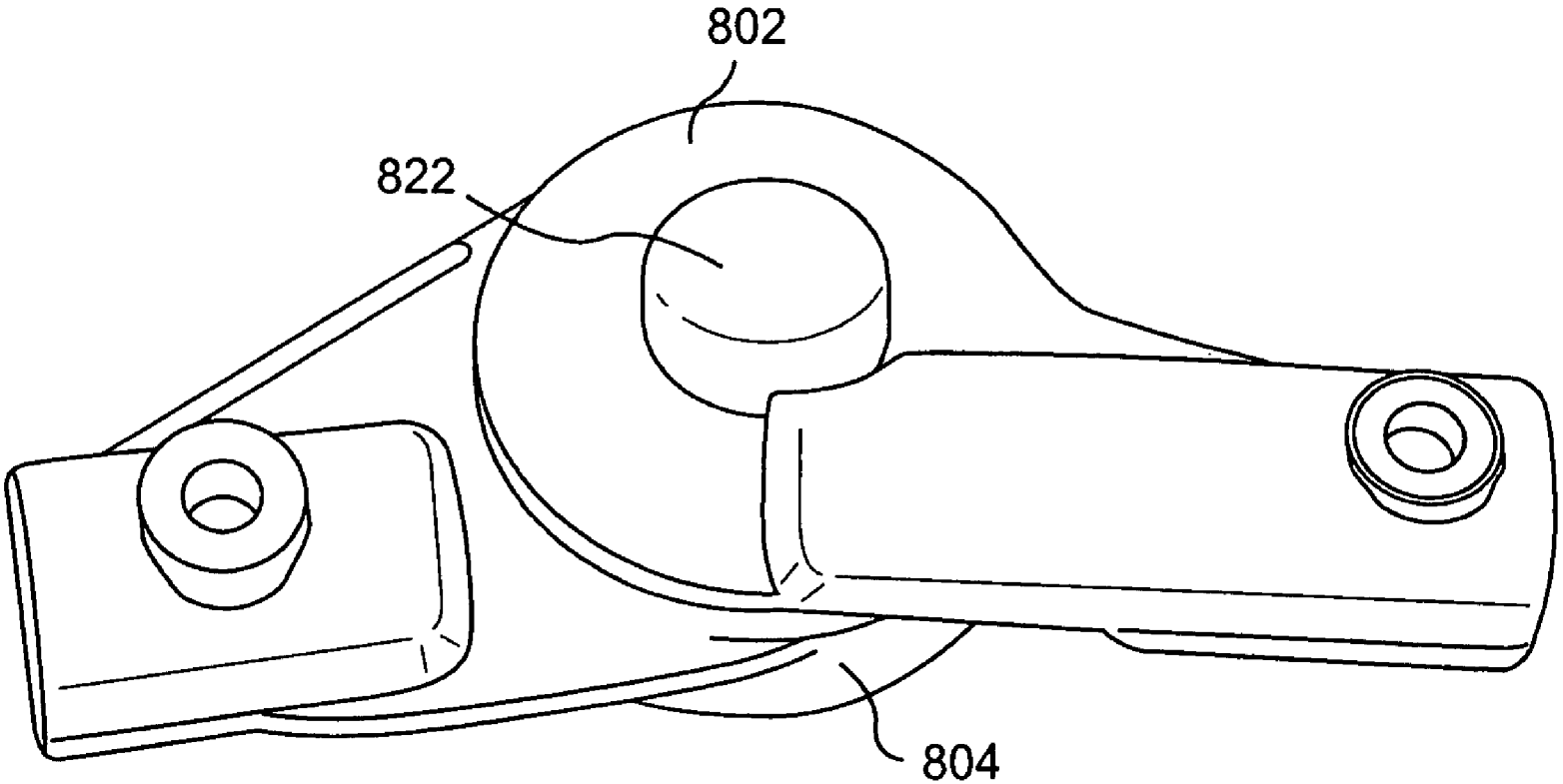
Figure 28B:
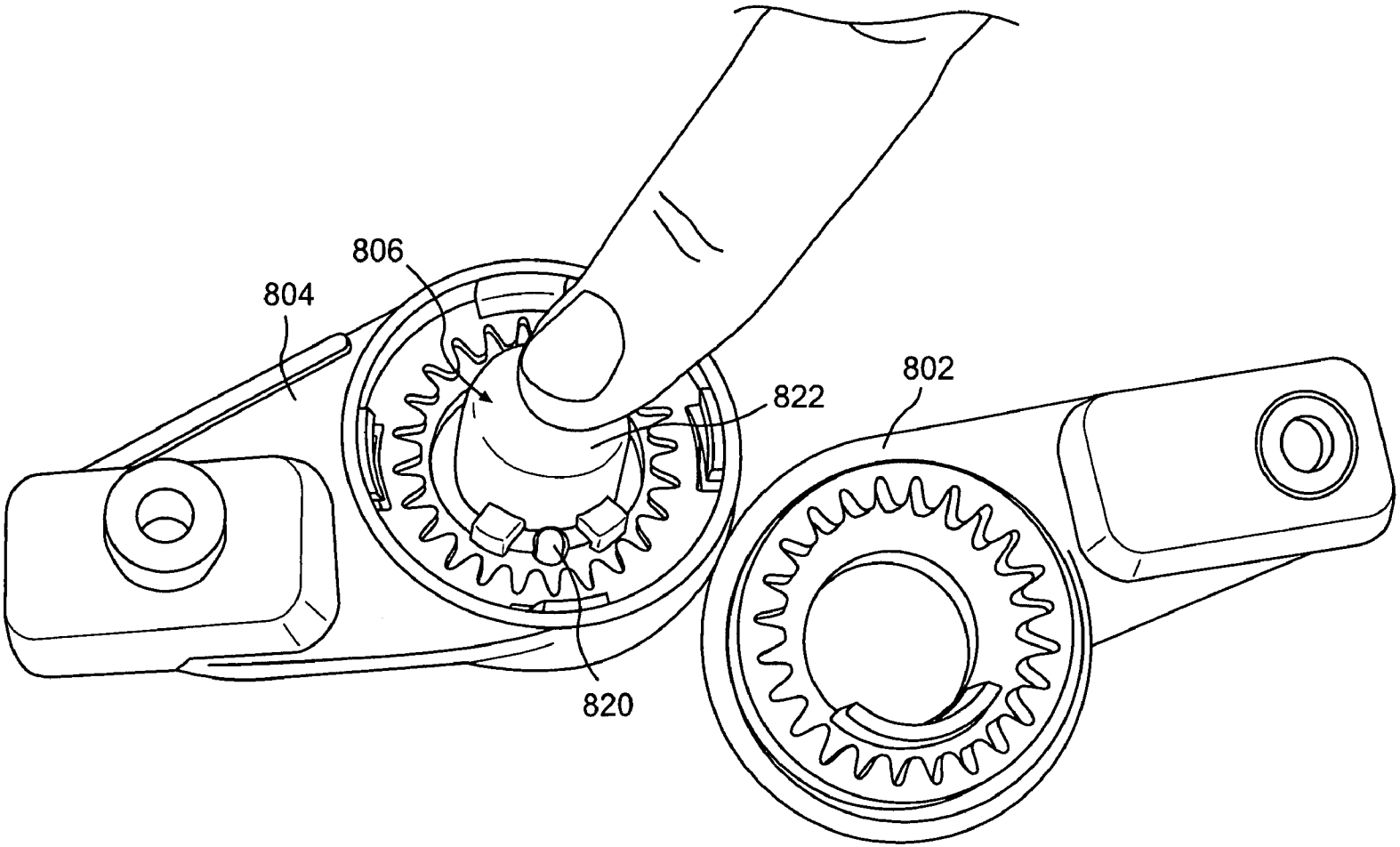
Figure 28C:
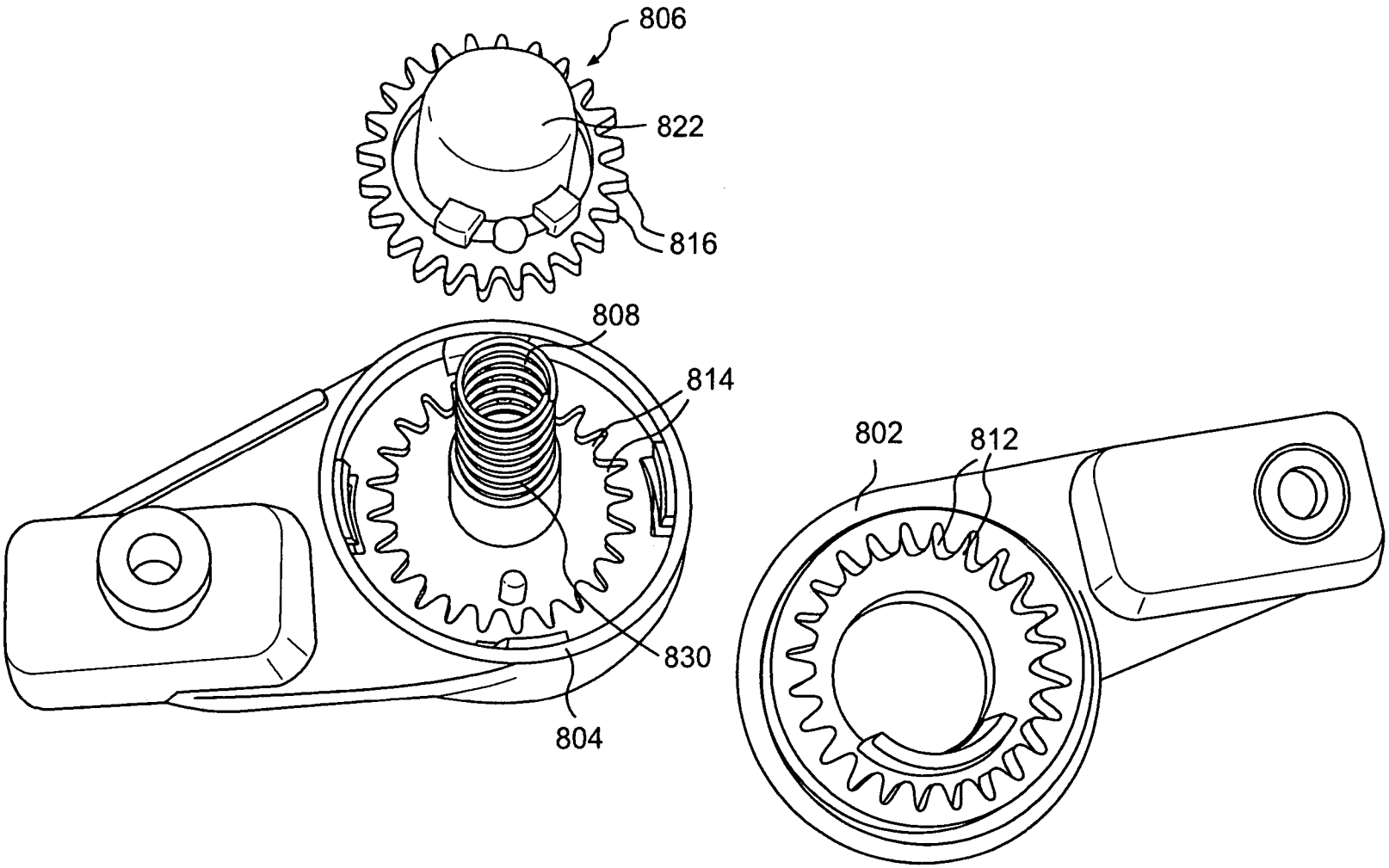

FIG. 28 illustrates yet another latch mechanism that can be used to lock the cross members 22 in a predefined open position. The latch mechanism comprises a bidirectional lock 800 that includes two disc-like housings 802, 804, which are mounted to a pair of cross members 22 at pivot P, and a toothed gear arrangement between the housings 802, 804. Housing 802 can be coupled to one of the cross members 22, and housing 804 can be coupled to the other of the cross members 22. One suitable gear arrangement is illustrated in FIGS. 28A-28C. As seen in FIG. 28C, the housings 802, 804 each have grooves 812, 814 to receive the teeth 816 of gear 806. The gear 806 is keyed to stay in place in housing 804 at key 820. When the button 822 extending through housing 802 is depressed, the gear 806 compresses the spring 830 and retracts fully in housing 802, allowing housing 804 to rotate in relation to housing 802. Once the rotation begins, the gear 806 is blocked from re-engaging housing 802 and relocking the latch mechanism 800 until its gear pattern realigns with the grooves 812 in housing 802. By varying the gear pattern, the latch mechanism 800 can engage at only specifically determined angles. In this regard, since the latch mechanism 800 can control pivoting of the cross members 22 to which it is attached. For example, the gear pattern can be varied to limit rotation of the cross members 22 between an open position and a folded position.

Figure 29:
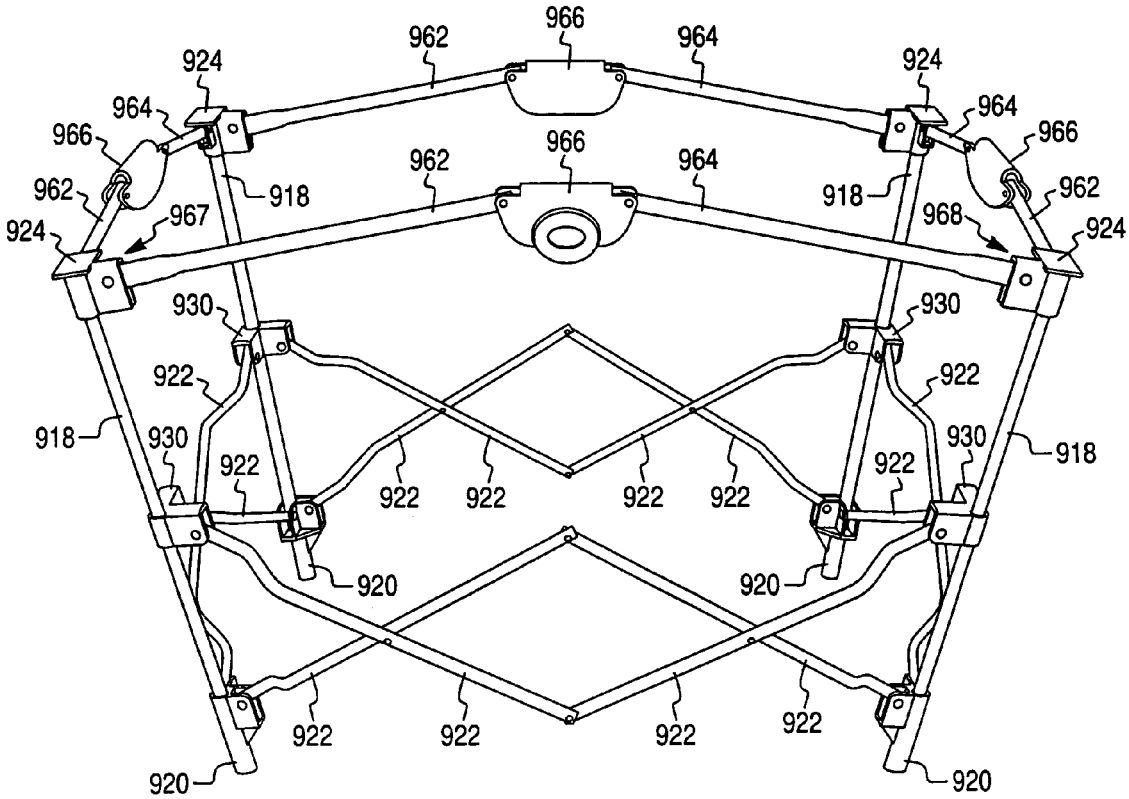
FIG. 29 is a perspective view of a collapsible frame structure having yet a further exemplary latch assembly in accordance with the present invention.

FIG. 29 shows a collapsible frame structure 912 of a playard in accordance with another aspect of the invention. The collapsible frame structure 912 includes a plurality of legs 918. The collapsible frame structure 912 is arranged in a partially open arrangement in FIG. 29 and may move between a fully open arrangement and a folded arrangement. The frame structure 912 also includes feet 920 at one end of each leg 918 and a top rail mount 924 at the other end of each leg 918.

A plurality of cross members 922 are arranged in pairs and are located and extend between respective legs 918. In this embodiment, the long sides of the playard have two pairs of cross members 922 between adjacent legs 918, and the short sides of the playard have one pair of cross members 922 between adjacent legs 918. The feet 920 of the frame structure 912 also serve as pivot joints, and the frame structure further includes a plurality of slider joints 930 that function to allow an end of a respective cross member 922 slide up and down the respective leg 918. In this arrangement, the fabric enclosure of the playard can include a bumper pad that fits adjacent the cross members 922, and can include mesh at the top of the enclosure, extending between the slider joints 930 and the top rails for example.

To maintain the collapsible frame structure 912 in a fully open arrangement, the frame structure 912 includes latch mechanisms in the form of top rails and fold mechanisms 966 along the top rails. The latch mechanisms, when latched, prevent movement of the collapsible frame assembly from an open arrangement to a folded arrangement. The top rails each comprise two stiff sections 962, 964, with a fold mechanism 966 intermediate end portions 967, 968 of the respective top rail. The fold mechanisms 966 couple the two sections 962, 964. In this embodiment, the top rails force the legs 918 apart a predefined distance and lock them in place. Movement of the legs 918 in turn causes the cross members 922 to rotate to a predefined angle in a fully open, deployed position. Upon actuation of the fold mechanisms 966, the two sections 962, 964 can fold, allowing the collapsible frame structure 912 to move to the folded arrangement. The fold mechanisms 966 may comprise, for example, a hinge, a fold latch as shown in FIG. 29, or a simple pivot assembly. Examples of appropriate fold latches are disclosed in, for example, U.S. patent application Ser. No. 09/969,498, filed on Oct. 3, 2001, now abandoned, and published on Apr. 3, 2003 as PG publication No. US 2003/0061658 A1.

As explained above, the latch mechanisms of FIGS. 10-16 and 21-29 are mounted to other frame components of the collapsible frame structure, such as the legs, the slider joints, the pivot joints, and the pivots between the cross members. These latch mechanisms remain so mounted, albeit in a different orientation relative to the other frame component, in both the open arrangement and the folded arrangement of the collapsible frame structure. For example, the latch mechanism 370 remains mounted to the leg 18 when the collapsible frame structure is in the open arrangement and in the closed arrangement, although the handle 372 and the bail 376 may be oriented in different positions in the two arrangements.

In addition, referring to FIGS. 2 and 29, the collapsible frame structure in accordance with this invention does not require a center hub, such as the hub shown in U.S. Pat. No. 5,697,111, to interconnect the legs and/or sides of the frame structure. The interior of the collapsible frame structure, defined by the sides of the frame structure, can be free of frame joints, such as a center hub. Such a "hub-free" configuration provides a relatively light, inexpensively manufactured, and easily collapsible frame structure. The embodiments of FIGS. 2 and 29, for example, illustrate collapsible frame structures having interiors that are free of frame joints. The pivot joints and the slider joints of these embodiments are associated with the legs of the frame structure; these joints are not located in an interior of the collapsible frame structure. Further, nonadjacent legs and nonadjacent sides of the collapsible frame structure can remain unconnected across an interior of the collapsible frame structure, for example as shown in FIGS. 2 and 29. It will be understood that, in certain embodiments, portions or all of some frame components can extend into the interior of the collapsible frame structure.

Further, it will be understood that the above-described latch mechanisms can be used on playards with a single pair of cross members defining each side of the playard, as shown in FIG. 2, or on playards in which more than one cross member defines one or more sides of the playard, as shown in FIG. 29. For example, the latch mechanisms can be used on square playards with two pairs of cross members per side, on rectangular playards with two pairs of cross members on the long sides and one pair of cross members on the short sides, or on other appropriately proportioned playards (for example, 3:2, 4:3, etc.). Such playards will move easily between the open arrangement and the folded arrangement, provided all cross members are of equal size.

It also will be understood that the latch mechanisms of FIGS. 10-16 and 21-28 can be employed on a playard in which pivot joints are located at the feet of the frame structure, rather than the top of the frame structure, similar to the arrangement shown in FIG. 29.

Further, the above-described collapsible frame structures can include a fabric enclosure mounted to and supported by the collapsible frame structure. Other suitable frame structures that can employ the above-described latch mechanisms include those described in copending application entitled "PLAYARD" to Gehr et al., filed Nov. 24, 2004, which is incorporated by reference.

The embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A collapsible frame structure movable between an open arrangement and a folded arrangement, comprising:

a plurality of legs;

a plurality of pivot joints, each pivot joint connected to one of the plurality of legs, respectively;

a plurality of slider joints, each slider joint slidingly engaging one of the plurality of legs, respectively;

a plurality of cross members arranged in pairs, at least one of the pairs extending between adjacent legs such that one of the slider joints connects at least one cross member of one of the pairs to one of the adjacent legs and one of the pivot joints connects at least one cross member of one of the pairs to the other of the adjacent legs;

at least one latch mechanism operable in a latched condition to maintain a predetermined gap along one of the legs between one of the slider joints and one of the pivot joints to prevent movement of the collapsible frame structure toward the folded arrangement, the gap having a height greater than that of the corresponding slider joint; and a plurality of top rail segments extending between the legs so as to define an upper periphery of the collapsible frame structure, the plurality of top rail segments comprising a pair of top rail segments connected between adjacent legs, the pair of top rail segments connected to each other via a fold mechanism that prevents the collapsible frame structure from moving from the open arrangement to the folded arrangement.

2. The collapsible frame structure as recited in claim 1, wherein the at least one cross member connected to the slider joint and the at least one cross member connected to the pivot joint comprise the same cross member.

3. The collapsible frame structure as recited in claim 1, wherein the at least one cross member connected to the slider joint and the at least one cross member connected to the pivot joint comprise different cross members.

4. The collapsible frame structure as recited in claim 1, wherein the cross member that is connected to the slider joint is connected to the slider joint via another cross member.

5. The collapsible frame structure as recited in claim 1, wherein the cross member that is connected to the pivot joint is connected to the pivot joint via another cross member.

6. The collapsible frame structure as recited in claim 1, wherein the at least one latch mechanism maintains a predetermined distance between the slider joint and the pivot joint of the one of the plurality of legs.

7. The collapsible frame structure as recited in claim 1, wherein at least one of the pair of cross members comprises cross members that pivotably intersect at a pivot, and wherein the at least one latch mechanism prevents movement of the intersecting cross members about the pivot.

8. The collapsible frame structure as recited in claim 1, wherein the at least one latch mechanism maintains a predetermined distance between at least two pivot joints.

9. The collapsible frame structure as recited in claim 1, wherein the at least one latch mechanism prevents at least a select one of the cross members from pivoting about the pivot joint.

10. The collapsible frame structure as recited in claim 1, wherein the at least one latch mechanism maintains a predetermined angle between a select one of the cross members and the one of the plurality of legs attached to the select one of the cross members by the slider joint.

11. The collapsible frame structure as recited in claim 1, wherein the cross members of at least one of the pair of cross members pivotably intersect at a pivot, and wherein the at least one latch mechanism is operatively connected between the intersecting cross members.

12. The collapsible frame structure as recited in claim 1, wherein the at least one latch mechanism is mounted to at least one of the legs.

13. The collapsible frame structure as recited in claim 1, wherein the at least one latch member is mounted to the top rails.

14. The collapsible frame structure as recited in claim 1, wherein a pair of top rail segments extends between each adjacent pair of legs, and each pair of top rail segments is connected by a fold mechanism that latches to prevent movement of the collapsible frame structure from the open arrangement to the folded arrangement.

15. The collapsible frame structure as recited in claim 1, wherein the fold mechanism comprises a latch mechanism that latches to prevent movement of the collapsible frame structure from the open arrangement to the folded arrangement.

* * * * *